US010610021B2

(12) United States Patent
Toland et al.

(10) Patent No.: US 10,610,021 B2
(45) Date of Patent: Apr. 7, 2020

(54) CHAIR SUPPORTED BY BELLOWS WITH MOTION CONTROL

(71) Applicant: Virco Mfg. Corporation, Torrance, CA (US)

(72) Inventors: Jamie Toland, Pottsville, AR (US); John Gregory, Enola, AR (US); Scott Lloyd Fletcher, Redondo Beach, CA (US)

(73) Assignee: VIRCO MFG. CORPORATION, Torrance, CA (US)

( * ) Notice: Subject to any disclaimer, the term of this patent is extended or adjusted under 35 U.S.C. 154(b) by 0 days.

(21) Appl. No.: 15/934,889

(22) Filed: Mar. 23, 2018

(65) Prior Publication Data

US 2018/0271291 A1 Sep. 27, 2018

Related U.S. Application Data

(60) Provisional application No. 62/477,348, filed on Mar. 27, 2017.

(51) Int. Cl.

| | |
|---|---|
| ***A47C 1/12*** | (2006.01) |
| ***A47C 3/02*** | (2006.01) |
| ***A47C 3/025*** | (2006.01) |
| ***A47C 3/04*** | (2006.01) |
| ***A47C 7/34*** | (2006.01) |
| ***A47C 7/44*** | (2006.01) |
| ***A47C 1/032*** | (2006.01) |

(52) U.S. Cl.

CPC ..... *A47C 7/347* (2013.01); *A47C 1/03222* (2013.01); *A47C 3/04* (2013.01); *A47C 7/446* (2013.01); *A47C 7/448* (2013.01)

(58) Field of Classification Search

CPC ..... A47C 7/347; A47C 1/03222; A47C 3/04; A47C 7/446; A47C 7/448

USPC ..... 297/239, 313, 314

See application file for complete search history.

(56) References Cited

U.S. PATENT DOCUMENTS

| | | | | | |
|---|---|---|---|---|---|
| 199,535 | A * | 1/1878 | Granger | A47C 3/029 | 297/452.5 |
| 288,608 | A * | 11/1883 | Bate | A47C 9/002 | 297/313 |
| 421,045 | A * | 2/1890 | Caldwell | A47C 3/025 | 297/302.4 |
| 521,463 | A * | 6/1894 | Smith-Fraser | A61G 5/00 | 297/372 |
| 1,127,413 | A * | 2/1915 | Davis | A47C 3/28 | 248/624 |
| 1,303,962 | A * | 5/1919 | Reed | F16F 15/067 | 248/578 |

(Continued)

FOREIGN PATENT DOCUMENTS

| | | | | |
|---|---|---|---|---|
| WO | WO-0117398 A1 * | 3/2001 | ..... | A47C 1/0242 |
| WO | WO 2016/067217 | 5/2016 | | |
| WO | WO 2016/067219 | 5/2016 | | |

*Primary Examiner* — Rodney B White

(74) *Attorney, Agent, or Firm* — Knobbe, Martens, Olson & Bear, LLP

(57) ABSTRACT

A chair has a seat portion and a leg portion. The seat portion and the leg portion are joined by a structure that allows that seat portion to wobble relative to the leg portion. The structure can include one or more resilient member to create the wobble and one or more motion restrictor member to limit the amount of wobble or prevent wobble.

15 Claims, 18 Drawing Sheets

(56) References Cited

U.S. PATENT DOCUMENTS 1,437,848 A * 12/1922 Lorenz ..... A47C 3/025 248/425
2,132,291 A * 10/1938 Fitos ..... A47C 3/025 297/314 X
2,799,323 A * 7/1957 Berg ..... A47C 3/025 297/314 X
3,058,778 A * 10/1962 Campbell ..... A47C 3/0252 297/284.3
3,080,195 A * 3/1963 Berg ..... A47C 7/14 297/312
3,190,693 A * 6/1965 Underdown, Sr. .... A47C 3/027 297/263.2
3,263,247 A * 8/1966 Knittel ..... A47C 27/06 267/117
3,280,410 A * 10/1966 Propst ..... A47C 4/54 267/117
3,547,393 A * 12/1970 Gordin ..... A47C 3/0252 248/582
3,784,148 A * 1/1974 Hill ..... A47C 3/025 248/582
3,881,713 A * 5/1975 Joyce ..... A47C 3/0252 248/624
4,025,020 A * 5/1977 Goff ..... A47C 3/025 248/582
4,157,203 A * 6/1979 Ambasz ..... A47C 7/441 297/285
4,333,683 A * 6/1982 Ambasz ..... A47C 3/025 297/292
4,372,606 A * 2/1983 Faull ..... A47C 3/025 297/313 X
4,437,702 A * 3/1984 Agosta ..... A47C 31/126 297/284.8
4,580,840 A * 4/1986 Cunningham ..... B60N 2/7011 297/452.18
4,640,548 A * 2/1987 Desanta ..... A47C 1/03255 297/300.1
4,830,345 A * 5/1989 Mar ..... A47C 7/14 297/314 X
4,893,871 A * 1/1990 Kowalski ..... A47C 3/0252 248/425
4,895,352 A * 1/1990 Stumpf ..... A47C 27/065 264/506
5,060,328 A * 10/1991 Larson ..... A47C 27/085 297/DIG. 8
5,159,725 A * 11/1992 Larson ..... A47C 27/085 5/683
5,253,377 A * 10/1993 Larson ..... A47C 27/085 267/122
5,904,398 A * 5/1999 Farricielli ..... A61G 5/00 297/313 X
6,019,154 A * 2/2000 Ma ..... B23K 20/10 100/258 R
6,079,782 A * 6/2000 Berg ..... A47C 7/024 297/312 X
6,209,843 B1 * 4/2001 Smith, Jr. ..... A47C 3/0252 248/346.01
6,279,998 B1 * 8/2001 Chu ..... A47C 1/023 297/338
6,595,586 B2 * 7/2003 Brightbill ..... A47C 3/025 297/314 X
6,626,494 B2 * 9/2003 Yoo ..... A47C 7/46 297/313 X
6,672,667 B1 * 1/2004 Park ..... B60N 2/42754 297/216.1
6,688,689 B1 * 2/2004 Thorn ..... A47C 3/0252 297/313 X
6,820,935 B1 * 11/2004 Cioncada ..... A47C 1/03255 297/300.1
6,827,401 B2 * 12/2004 Marshall ..... A47C 1/03255 297/302.1
6,866,340 B1 * 3/2005 Robertshaw ..... A47C 7/024 297/314 X
7,100,983 B1 * 9/2006 Gant ..... A47C 3/025 297/314 X
7,387,339 B2 * 6/2008 Bykov ..... A47C 3/0252 297/312
7,806,479 B2 * 10/2010 Jensen ..... A47C 9/002 248/158
7,922,247 B2 * 4/2011 Dickie ..... A47C 7/446 297/314 X
8,007,417 B2 * 8/2011 Heller ..... A63B 22/18 482/112
8,888,184 B2 * 11/2014 Meyer ..... A47C 3/0252 297/258.1
9,661,929 B1 * 5/2017 Koh ..... A47C 7/14
10,039,384 B1 8/2018 Yoo
10,194,754 B2 * 2/2019 Choi ..... A47C 7/14
10,219,628 B2 * 3/2019 Reinhard ..... A47C 7/14
2014/0252824 A1 * 9/2014 Saint Pierre ..... A47C 3/04 297/239
2017/0290433 A1 * 10/2017 Reinhard ..... A47C 7/14

* cited by examiner

CHAIR SUPPORTED BY BELLOWS WITH MOTION CONTROL

RELATED APPLICATIONS

Any and all applications for which a foreign or domestic priority claim is identified in the Application Data Sheet as filed with the present application are incorporated by reference under 37 CFR 1.57 and made a part of this specification.

BACKGROUND

Field

The present disclosure generally relates to chairs that comprise a seat supported by bellows, wherein the seat is configured to be optionally movable or tiltable in multiple directions.

Description of the Related Art

Chairs are used in many different settings. In many cases, chairs fail to fit the needs of individuals in the particular setting in which they are used. In the classroom setting, for example, some chairs may fail to accommodate the natural movement of the child or student. Rather, such chairs are made for the child or student to sit up straight and still. Convenience plays a critical role in the way classroom chairs are made. In the classroom setting, chairs are made to be stackable. In some cases, a desire to maximize the stackability of classroom chairs limits the ability of chair makers to make chairs that optimize student comfort, health, and productivity.

Another consideration that has slowed the development of classroom chairs that accommodate seated movement is a desire to not ostracize children or students who are otherwise unable to sit in movable or tiltable chairs without creating a distraction to themselves or others in the room. In other words, it is not desirable to have two types of chairs in the same classroom: movable ones for the masses and non-movable ones for a select few students.

Alternatives to chairs have been used to make up for the lacking comfort, health, and productivity benefits of existing chair designs. For example, balls, including yoga exercise balls, are sometimes used for seating purposes. Yoga exercise balls are used for seating purposes because they can accommodate the natural movement of the seated individual. However, yoga exercise ball chairs fail to provide the stability and back support desired in many seating applications.

Customers and users of classroom chairs are increasingly demanding chairs be made that optimize student comfort, health, and productivity while retaining the ability to be stacked.

SUMMARY OF CERTAIN EMBODIMENTS

Accordingly, a stackable chair has been developed that includes features that permit movement of the seat while the individual is seated, along with an option for locking, limiting, or precluding said movement.

The methods and devices described herein have innovative aspects, no single one of which is indispensable or solely responsible for their desirable attributes. Without limiting the scope of the claims, some of the advantageous features will now be summarized.

In some embodiments, a chair comprises a seat component. The seat component comprises a seat portion with a bottom surface and a back support portion. The seat portion and the back support portion comprise a uniform body. An intermediate support component is joined to the seat component and comprises a first plate and a second plate. The first plate is joined to the bottom surface of the seat portion. The second plate comprises a hole. The first plate and the second plate are spaced apart from each other using a first bellows, a second bellows, a third bellows, and a fourth bellows. The first plate and the second plate are coupled together using a first rod, a second rod, a third rod, and a fourth rod. Each of the first rod, the second rod, the third rod, and the fourth rod is at least partially contained within one of the first bellows, the second bellows, the third bellows, and the fourth bellows. A motion control mechanism is selectively engagable with the first plate and extends through the hole of the second plate. A leg component comprises a first pair of legs and a second pair of legs. Each of the first pair of legs and the second pair of legs is joined to the second plate.

In some embodiments, the motion control mechanism comprises a stop element and the hole of the second plate comprises a threaded hole. The stop element comprises a first portion, a second portion, and a thread pattern positioned between the first portion and the second portion. The thread pattern enables the stop element to rotated relative to the threaded hole of the second plate.

In some embodiments, the first portion of the stop element of the motion control mechanism engages the first plate to limit relative movement of the first plate relative to the second plate.

In some embodiments, the motion control mechanism is disengaged when the first portion of the stop element is not contacting the first plate.

In some embodiments, the motion control mechanism comprises a handle that is connected to at least one wedge block. The at least one wedge block is movable between a first position within a socket defined within the intermediate support component and a second position that is engaged with the first plate.

In some embodiments, the first rod, the second rod, the third rod, and the fourth rod are coupled to each of the first plate and the second plate in such manner as to allow the first rod, the second rod, the third rod, and the fourth rod to move axially but not laterally to any appreciable extent when a force is applied to the seat component.

In some embodiments, a chair has a seat portion that is capable of selective wobbling relative to a leg portion. The seat portion is joined to a first plate and the leg portion is joined to a second plate. The first plate and the second plate are spaced apart by one or more resilient member. The first plate and the second plate have a range of motion that can be locked out by a motion control mechanism. The motion control mechanism is positioned at least partially between the first plate and the second plate.

In some embodiments, the motion control mechanism comprises a stop element that translates relative to the second plate.

In some embodiments, a range of motion of the stop element is limited by the first plate.

In some embodiments, the stop element comprises a first threaded surface and the second plate comprises a second threaded surface. The first threaded surface and the second threaded surface cooperate together to guide movement of the stop element relative to the second plate.

In some embodiments, the stop element comprises a first portion that contacts the first plate.

In some embodiments, the stop element also comprises a second portion configured to the grasped by a user for manipulating the stop element in a rotational direction.

In some embodiments, at least one limiter member is connected to the first plate and the second plate such that movement of the first plate and the second plate away from each other is limited.

In some embodiments, a first end of the limiter member is fixed relative to the first plate and a second end of the limiter member is movable relative to the second plate.

In some embodiments, the one or more resilient member comprises a bellows that is positioned between the first plate and the second plate.

In some embodiments, the limiter member is a rod that extends through the bellows.

In some embodiments, a chair has a seat portion that is capable of selective wobbling relative to a leg portion. The seat portion and the leg motion are joined by a means for controlling wobbling movement of the seat portion relative to the leg portion.

In some embodiments, the means comprises a resilient member, a motion range limiter, and a stop element such that the stop member can lock the seat portion from movement relative to the leg portion.

BRIEF DESCRIPTION OF THE DRAWINGS

Throughout the drawings, reference numbers have been reused to indicate general correspondence between reference elements. The drawings are provided to illustrate an example embodiment described herein and are not intended to limit the scope of the disclosure.

DETAILED DESCRIPTION OF THE PREFERRED EMBODIMENTS

FIGS. 1-10 show various views of a chair 100 that is arranged and configured in accordance with certain features, aspects and advantages of the present disclosure. In some embodiments, the chair 100 comprises three main components. In the illustrated embodiment, the chair 100 generally comprises a seat 102, an intermediate support 104, and one or more legs 106. The intermediate support 104 can interconnect or couple the seat 102 and the legs 106.

One or more of the three main components can be structured as a subassembly or module. As used herein, a module is a set of standardized parts or independent units that can be used to construct a more complex structure. In some embodiments, one or more of the modules can be used in other configurations. In some embodiments, the seat 102 can be a module that is usable in the assembly of other chairs or desks, for example, and the legs 106 can be another module that is usable in the assembly of other chairs or desks, for example. The intermediate support 104 is a module that links the seat 102 and the legs 106 and also is useable in other chairs or desks, for example.

Figure 4:
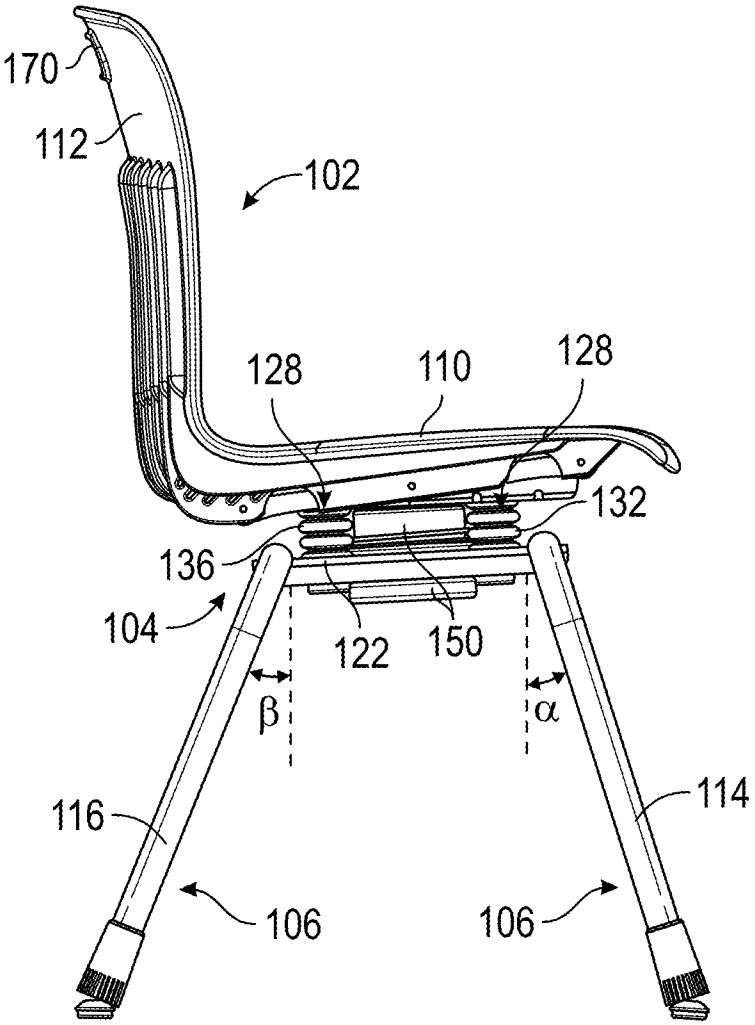
FIG. 4 is a right side view of the chair of FIG. 1.
Figure 7:
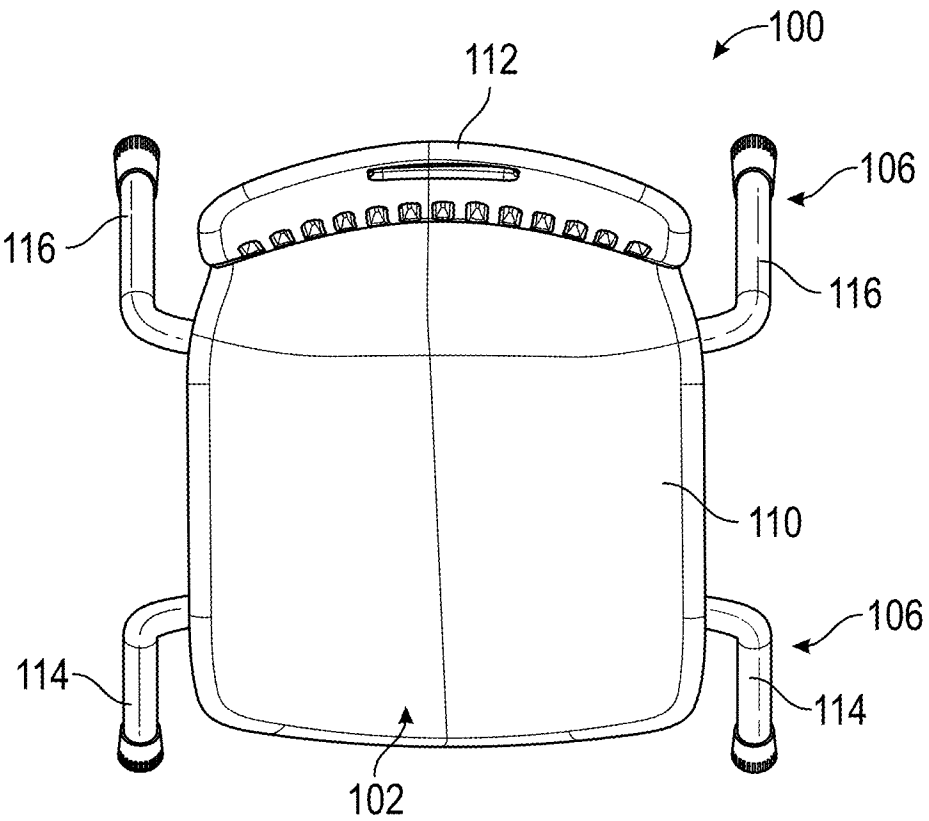
FIG. 7 is a top view of the chair of FIG. 1.

With reference to FIGS. 4 and 7, the seat 102 generally comprises a seat portion 110 and a back support portion 112. The seat portion 110 and the back support portion 112 can be integrally formed as a monolithic structure as shown in the illustrated embodiment. In some embodiments, the back support portion 112 can be a component or subassembly that is separate of and distinct from the seat portion 110 and the seat 102 can be a module. In other words, the back support portion 112 can be separately formed relative to the seat portion 110 but the two can be connected together. In some such embodiments, the back support portion 112 and the seat portion 110 can be interconnected using one or more posts, frames, or any other suitable structure. In some embodiments, the seat 102 may not include a back support portion 110 at all. In some embodiments, the back support portion 112 comprises a handhold, one or more openings, or other suitable configurations that can define a handle 170. The handle 170 enables the chair 100 to be moved or carried away more easily.

With reference still to FIGS. 4 and 7, the illustrated legs 106 comprise a first pair of legs 114 and a second pair of legs 116. The first pair of legs 114 can be a front pair of legs. The second pair of legs 116 can be a rear pair of legs. Other arrangements (e.g., single leg members, three leg assemblies, or four leg assemblies) are possible. In some configurations, the first pair of legs 114 and the second pair of legs 116 can be connected to the rest of the chair 100 by being connected to a portion of the intermediate support 104.

In the illustrated embodiment, the first pair of legs 114 and the second pair of legs 116 are attached or joined to rest of the chair 100 at a first angle $\alpha$ and a second angle $\beta$, respectively, relative to a vertical plane when viewed from the side while the chair 100 is in the use position. The first angle $\alpha$ and the second angle $\beta$ enable the chair to remain in a stable position when in use. In some configurations, the first angle α is smaller than the second angle β (i.e., the front legs are more upright than the rear legs). As shown in the front and rear views of FIGS. 3 and 6, lower portions of the pair of legs 114, 116 can extend generally vertically downward from an upper portion at a right angle when the chair 100 is viewed from the front or rear. Such a configuration improves the ability to stack the chairs and allows the chairs to be tightly spaced in a side-by-side configuration.

The seat 102 and/or the legs 106 can have any suitable configuration. In some configurations, embodiments of the seat 102 and/or the legs 106 can be configured as shown and described in any of the following patents, each of which is hereby incorporated by reference in its entirety: U.S. Design Pat. No. 742,153, issued on Nov. 3, 2015 and entitled Chair Seat; U.S. Design Pat. No. 730,095, issued on May 26, 2015 and entitled Desk; U.S. Design Pat. No. 686,439, issued Jul. 23, 2013 and entitled Chair Bucket; U.S. Design Pat. No. 686,032, issued Jul. 16, 2013 and entitled Chair; U.S. Design Pat. No. 686,860, issued Jul. 30, 2013 and entitled Chair with Curved Legs and Back Support; U.S. Design Pat. No. 686,859, issued Jul. 30, 2013 and entitled Chair with Curved Legs; U.S. Design Pat. No. 686,858, issued Jul. 30, 2013 and entitled Chair with Curved Legs and Back Support; U.S. Design Pat. No. 686,857, issued Jul. 30, 2013 and entitled Chair with Curved Legs; U.S. Design Pat. No. 564,768, issued Mar. 25, 2008 and entitled Task Chair; U.S. Design Pat. No. 547,980, issued Feb. 27, 2007 and entitled Chair Bucket; U.S. Design Pat. No. 547,979, issued Aug. 7, 2007 and entitled Chair Frame; U.S. Design Pat. No. 549,018, issued Aug. 21, 2007 and entitled Chair Bucket; U.S. Pat. No. 7,380,879, issued Jun. 3, 2008 and entitled Self-Leveling Furniture Leg Foot; U.S. Design Pat. No. 544,230, issued Jun. 12, 2007 and entitled Chair; U.S. Design Pat. No. 522,265, issued Jun. 6, 2006 and entitled Chair; U.S. Design Pat. No. 521,750, issued on May 30, 2006 and entitled Chair Desk Combination; U.S. Design Pat. No. 521,757, issued May 30, 2006 and entitled Chair; U.S. Design Pat. No. 521,751, issued on May 30, 2006 and entitled Chair Desk Combination; U.S. Design Pat. No. 521,283, issued May 23, 2006 and entitled Chair Seat; U.S. Design Pat. No. 520,782, issued May 16, 2006 and entitled Chair Back; U.S. Design Pat. No. 520,768, issued May 16, 2006 and entitled Chair; U.S. Design Pat. No. 523,265, issued on Jun. 20, 2006 and entitled Chair Desk Combination Frame; U.S. Design Pat. No. 513,892, issued on Jan. 31, 2006 and entitled Chair/Desk; U.S. Design Pat. No. 522,777, issued on Jun. 13, 2006 and entitled Chair Desk Combination Frame; U.S. Design Pat. No. 521,282, issued May 23, 2006 and entitled Chair Desk Combination Frame; U.S. Design Pat. No. 514,829, issued on Feb. 14, 2006 and entitled Chair/Desk; U.S. Design Pat. No. 542,039, issued on May 8, 2007 and entitled Chair/Desk; U.S. Pat. No. 7,059,670, issued on Jun. 13, 2006 and entitled Stackable Chair-Desk Frame; U.S. Design Pat. No. 514,339, issued Feb. 7, 2006 and entitled Task Chair; U.S. Design Pat. No. 507,893, issued Aug. 2, 2005 and entitled Stool; U.S. Design Pat. No. 504,026, issued Apr. 19, 2005 and entitled Task Chair; U.S. Design Pat. No. 513,911, issued Jan. 31, 2006 and entitled Chair Seating Assembly; U.S. Design Pat. No. 512,252, issued Dec. 6, 2005 and entitled Rocking Chair Carriage Assembly; U.S. Design Pat. No. 526,134, issued Aug. 8, 2004 and entitled Rocking Chair; U.S. Pat. No. 7,147,284, issued Dec. 12, 2006 and entitled Student Desk Chair with Rockers Rails; U.S. Design Pat. No. 503,559, issued Apr. 5, 2005 and entitled Chair; U.S. Design Pat. No. 507,890, issued on Aug. 2, 2005 and entitled Chair and Desk Combination; U.S. Design Pat. No. 505,022, issued May 17, 2005 and entitled Chair and Desk Combination; U.S. Design Pat. No. 499,260, issued Dec. 7, 2004 and entitled Chair; U.S. Design Pat. No. 488,630, issued Apr. 20, 2004 and entitled Stool; U.S. Design Pat. No. 461,348, issued Aug. 13, 2002 and entitled Chair Portion; U.S. Design Pat. No. 461,322, issued Aug. 13, 2002 and entitled Chair; U.S. Design Pat. No. 471,729, issued Mar. 18, 2003 and entitled Four-Legged Chair; U.S. Design Pat. No. 469,969, issued Feb. 11, 2003 and entitled Four-Legged Chair; U.S. Pat. No. 6,585,320, issued Jul. 1, 2003 and entitled Tilt Control Mechanism for a Tilt Back Chair; U.S. Design Pat. No. 469,284, issued Jan. 28, 2003 and entitled Chair; U.S. Design Pat. No. 469,265, issued Jan. 28, 2003 and entitled Chair; U.S. Pat. No. 6,533,352, issued Mar. 18, 2003 and entitled Chair with Reclining Back Rest; U.S. Design Pat. No. 441,557, issued May 8, 2001 and entitled Lightweight Chair; U.S. Design Pat. No. 437,124, issued Feb. 6, 2001 and entitled Chair; U.S. Pat. No. 5,954,396, issued Sep. 21, 1999 and entitled Chair Construction; U.S. Design Pat. No. 417,342, issued Dec. 7, 1999 and entitled Chair with Tablet Arm; U.S. Design Pat. No. 414,618, issued Oct. 5, 1999 and entitled Sled-Base Chair; U.S. Pat. No. 5,924,770, issued Jul. 20, 1999 and entitled Chair Construction; U.S. Design Pat. No. 410,801, issued Jun. 8, 1999 and entitled Chair with Arm Rests; U.S. Pat. No. 6,003,948, issued Dec. 21, 1999 and entitled Chair Construction; U.S. Design Pat. No. 417,969, issued Dec. 28, 1999 and entitled Chair Frame; U.S. Pat. No. 6,116,692, issued Sep. 12, 2000 and entitled Chair Construction; U.S. Pat. No. 4,768,833, issued Sep. 6, 1988 and entitled Chair Construction; U.S. Design Pat. No. 289,235, issued Apr. 14, 1987 and entitled Chair; and U.S. Pat. No. 4,400,031, issued Aug. 23, 1983 and entitled Interlocking Chair.

Figure 9:
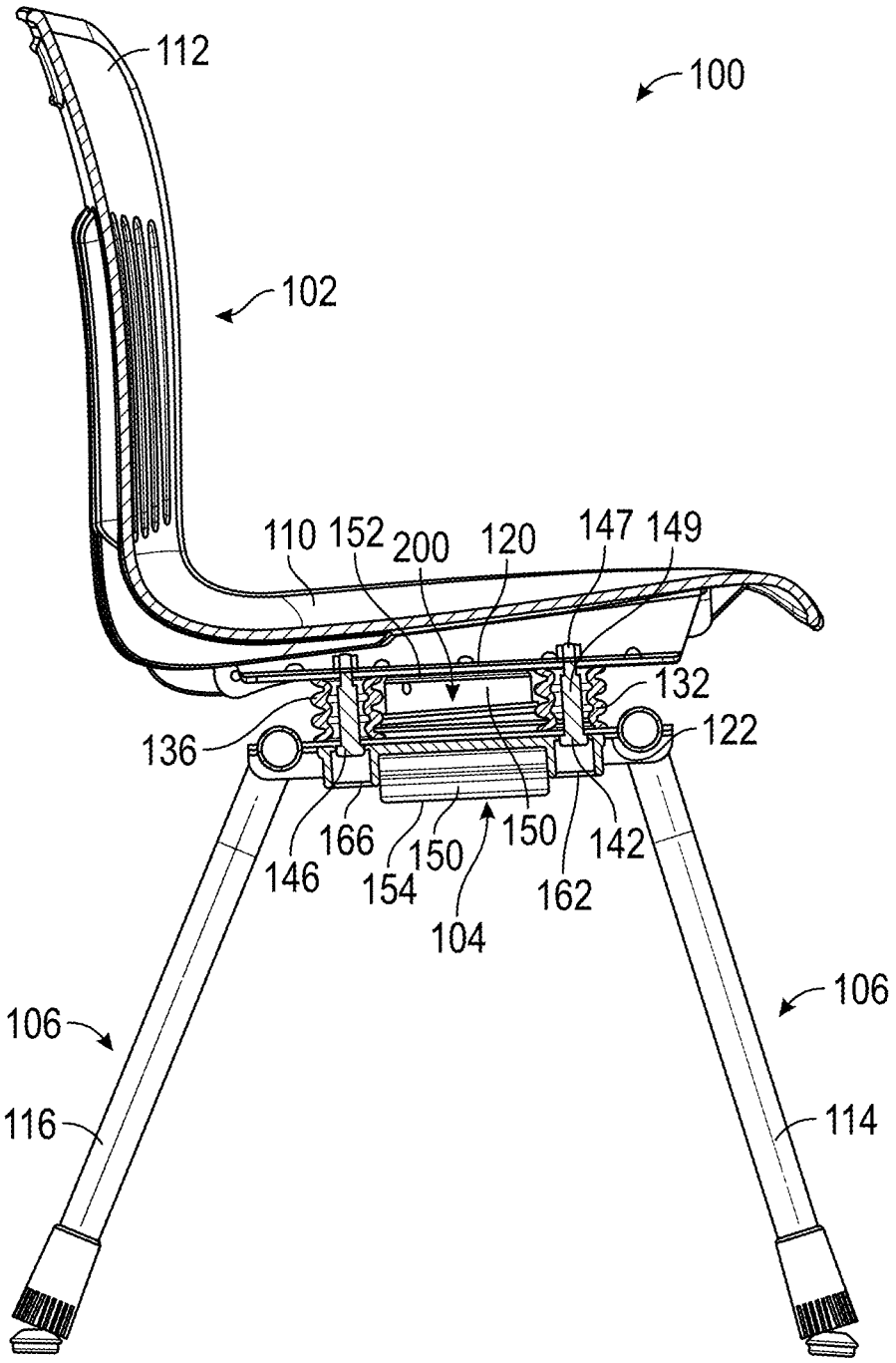
FIG. 9 is a right side cross-sectional view of the chair of FIG. 1 illustrating two of the bellows used with the motion control mechanism.
Figure 10:
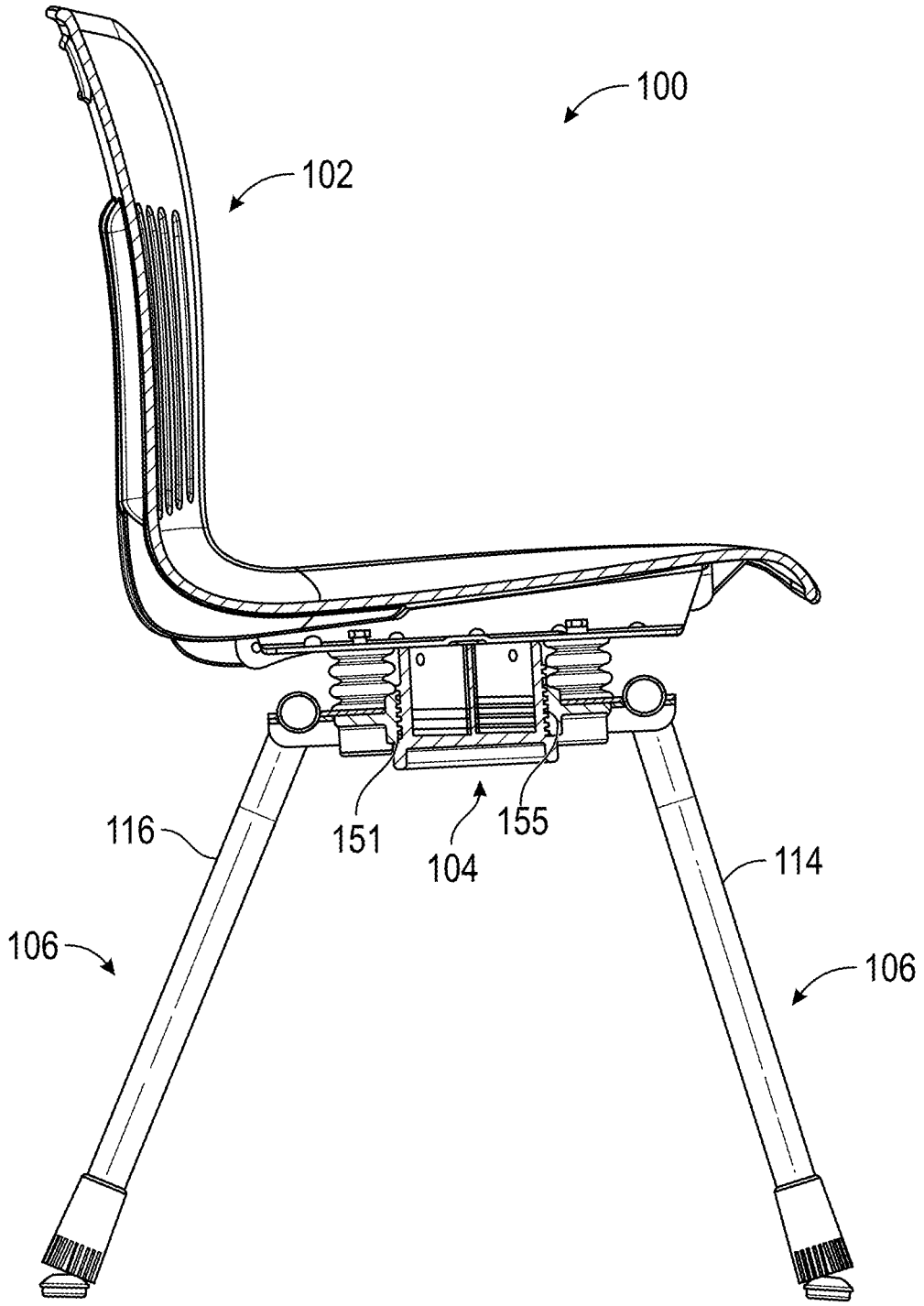
FIG. 10 is a right side cross-sectional view of the chair of FIG. 1 illustrating a portion of the motion control mechanism.

With reference to FIGS. 4 and 9, the illustrated intermediate support 104 comprises a first plate 120 and a second plate 122. The first plate 120 can be attached to the seat portion 110. In some embodiments, the first plate 120 is rigidly attached to the seat portion 110. In some embodiments, the first plate 120 is attached to the seat portion 110 such that the first plate 120 is positioned entirely underneath the seat portion 110. The second plate 122 can be attached to the legs 106. In some embodiments, the second plate 122 is rigidly attached to the legs 106. In some embodiments, the legs 106 overlie at least a portion of the second plate 122. In such embodiments, the legs 106 have a portion (e.g., the upper portion) that extends horizontally along the front and rear of the intermediate support 104. The legs 106 thereby obscure at least a portion of the intermediate support 104. In some embodiments, the legs 106 obscure at least a portion of the second plate 122.

The first plate 120 and the second plate 122 preferably are vertically spaced apart from each other. As will be explained, the movement and restriction of movement discussed above generally results from relative movement and restricted movement between the first plate 120 and the second plate 122. The first plate 120 is supported above the second plate 122 such that the first plate 120 can wobble relative to the second plate 122. In some embodiments, the first plate 120 can move or wobble relative to the second plate 122 about a generally vertically extending axis. As used herein, wobble means movable with an irregular rocking or staggering motion in at least a side-to-side direction and/or a front-to-back direction. As will be described, the amount of wobbling can be controlled, limited, and prevented, as desired.

Figure 1:
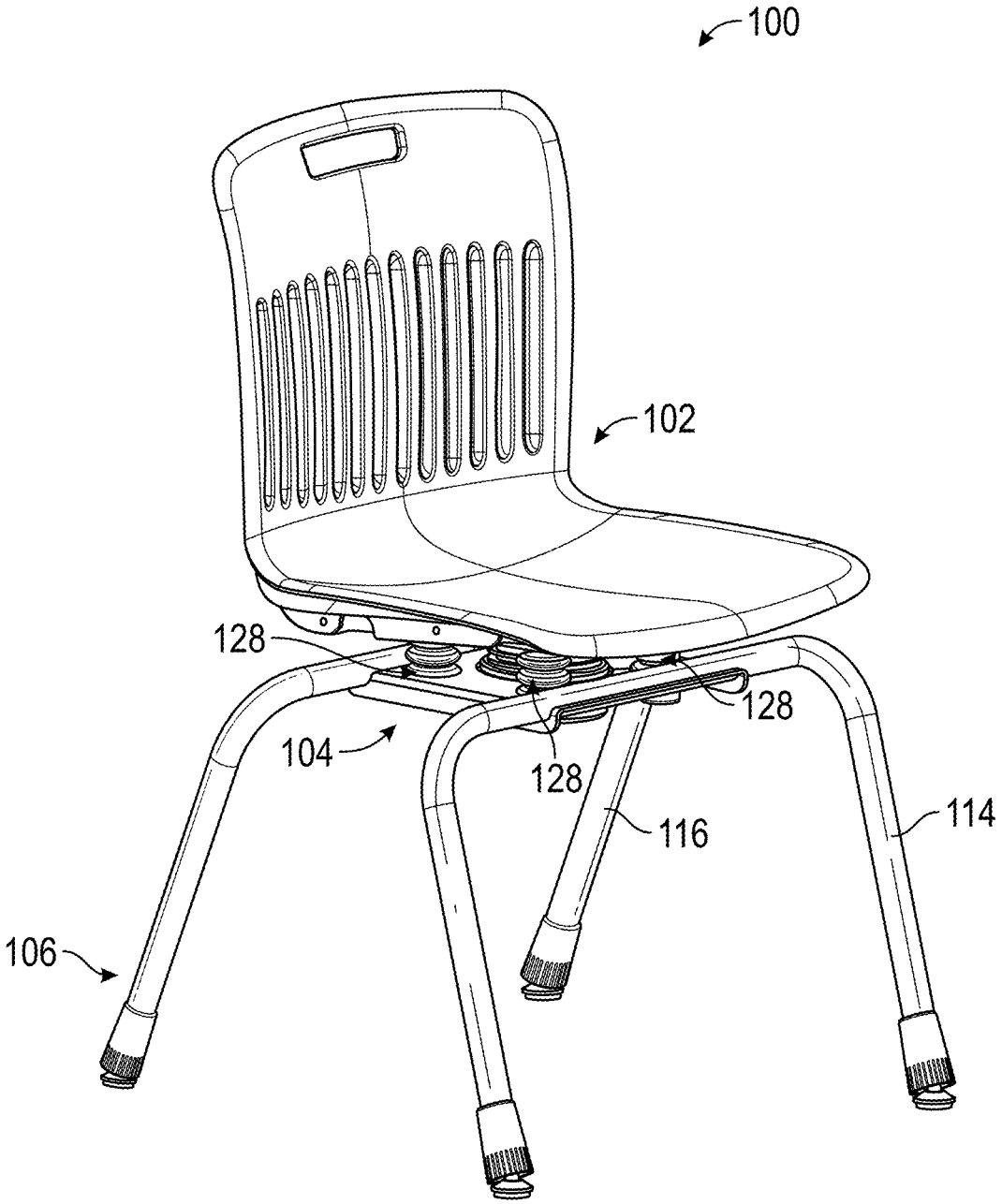
FIG. 1 is a front perspective view of a chair that is arranged and configured in accordance with certain features, aspects, and advantages of the present disclosure.
Figure 2:
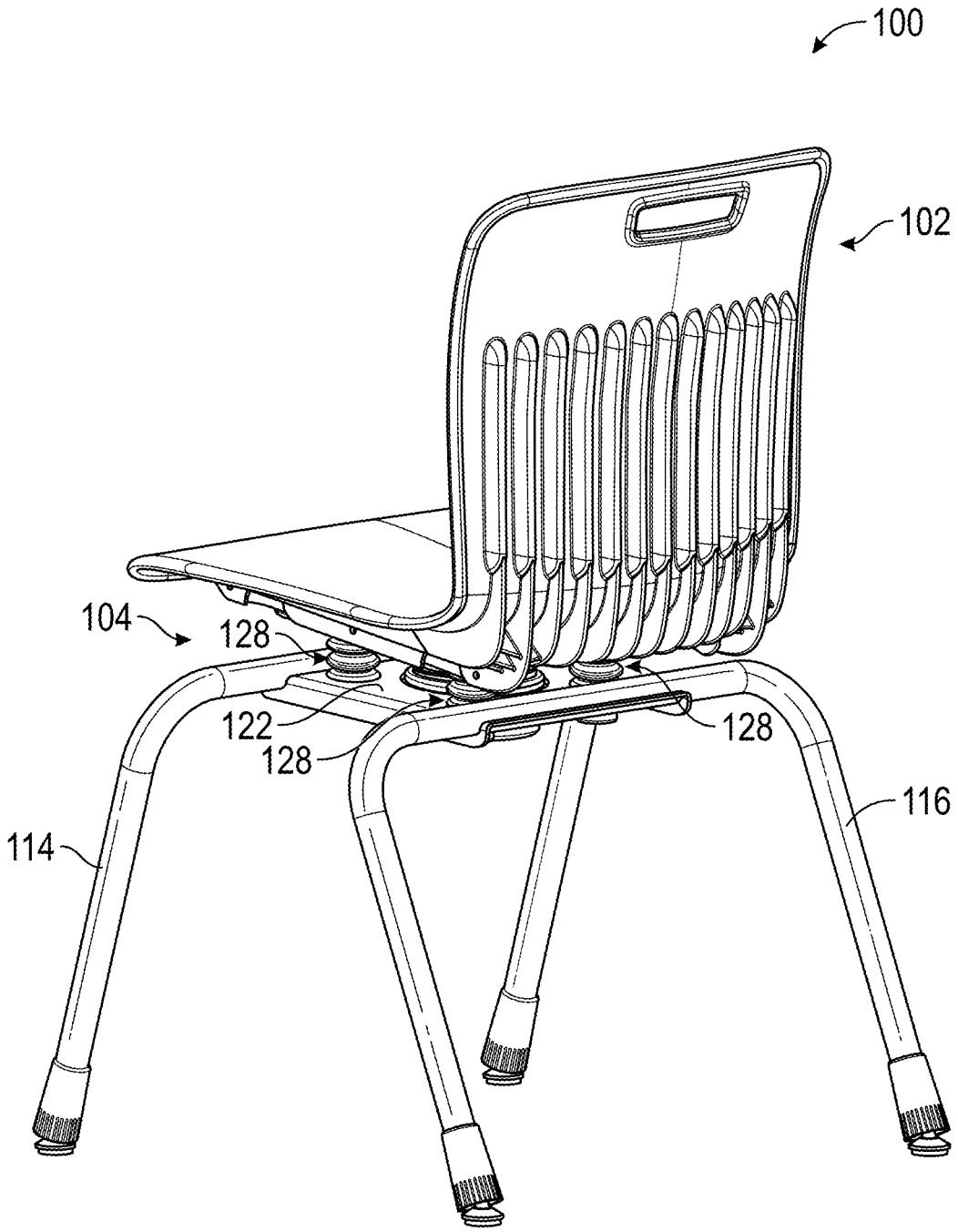
FIG. 2 is a rear perspective view of the chair of FIG. 1.
Figure 3:
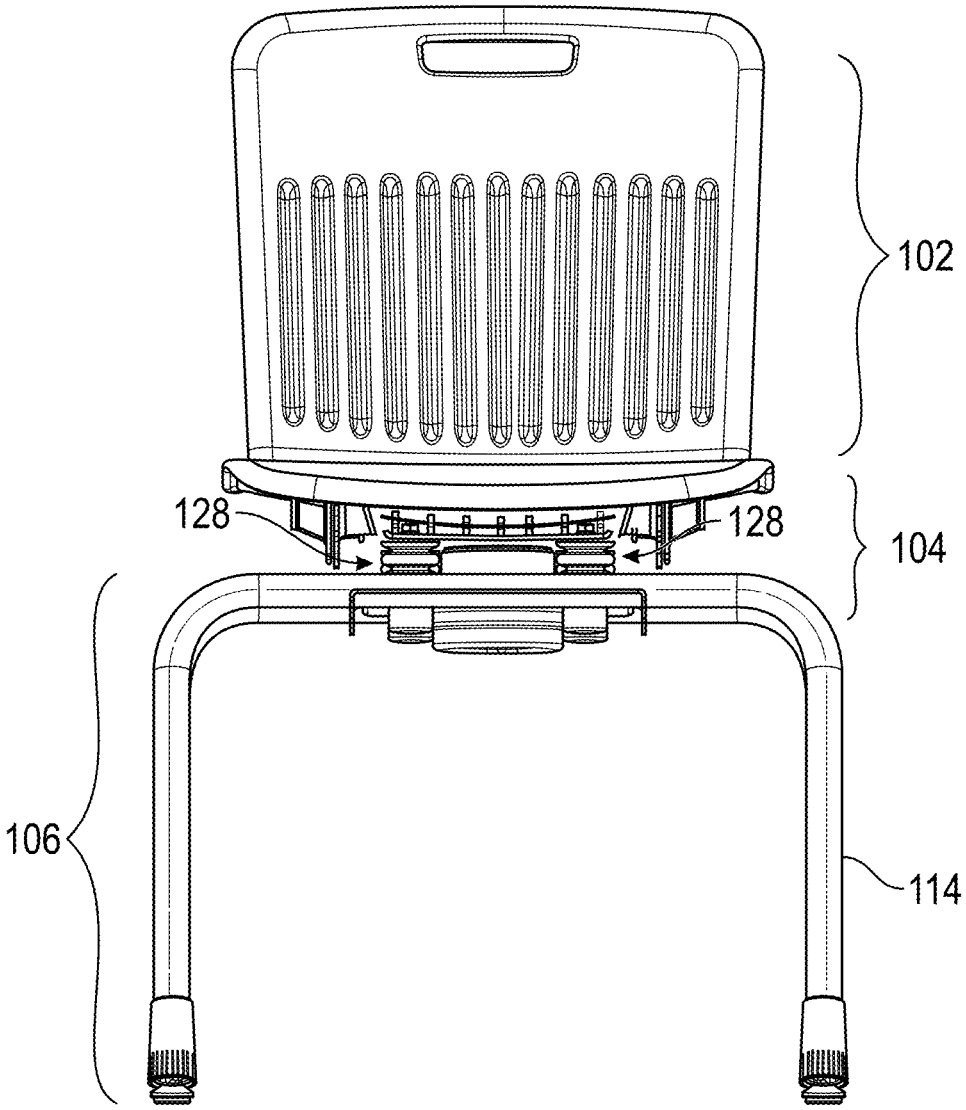
FIG. 3 is a front view of the chair of FIG. 1.
Figure 5:
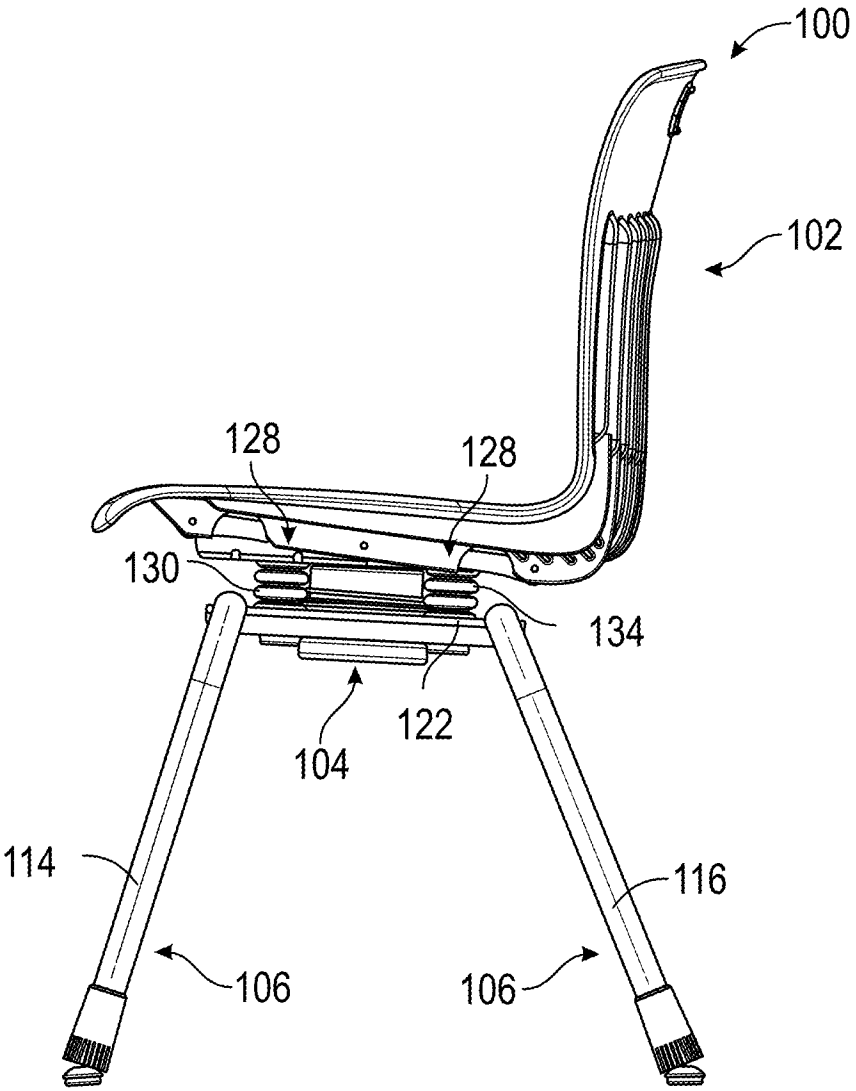
FIG. 5 is a left side view of the chair of FIG. 1.
Figure 6:
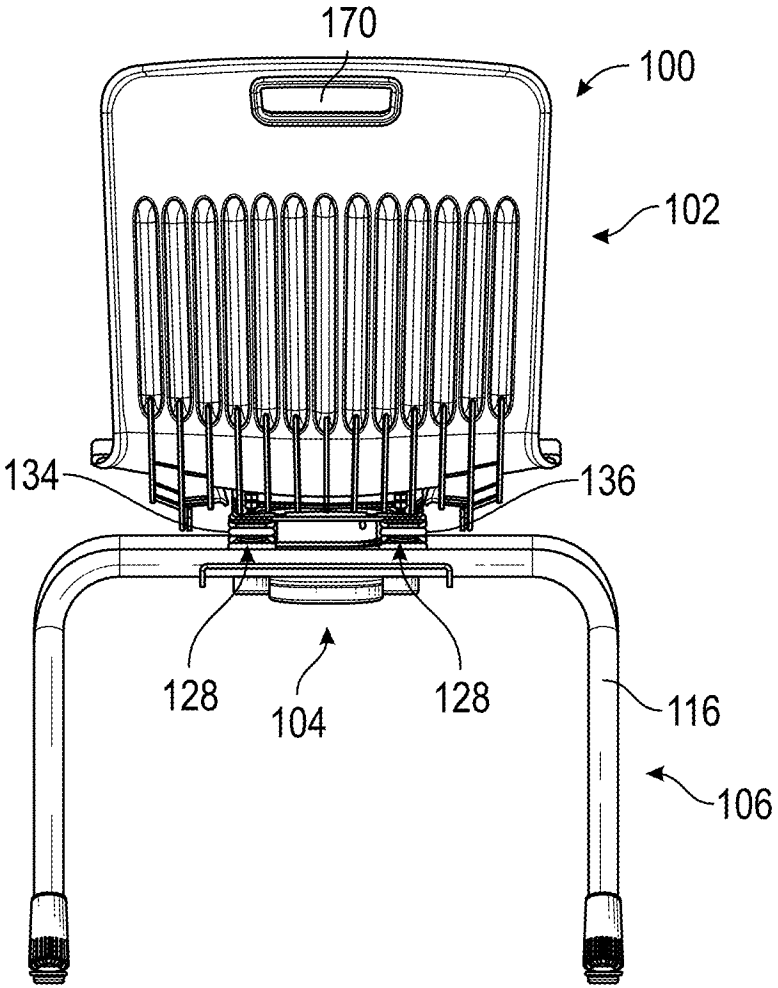
FIG. 6 is a rear view of the chair of FIG. 1.

As shown in FIGS. 4-6, at least one resilient member 128 supports the first plate 120 relative to a second plate 122.

The at least one resilient member 128 enables the desired wobbling movement of the first plate 120 relative to the second plate 122. The placement of the at least one resilient member 128 relative to the axis about which the first plate 120 wobbles can, at least in part, dictate the pattern or patterns of movement that can be accommodated and/or resisted between the plates 120, 122.

The resilient member 128 can be any suitable elastic body or device that recovers its original shape after being distorted or that is elastically deformed during use. For example, the resilient member 128 can be a coil spring, a leaf spring, a bellows, or the like. In some configurations, as used herein, the bellows is a metallic or elastomeric member that is flexible and expansible. In some configurations, the bellows is a folding bellows while, in other configurations, the bellows can be a rolling bellows. While rubber blocks, flexing plates and flexible tubular members can be used, the bellows are preferred for the ability to control both compressibility and the response time to return to an uncompressed state. While the following discussion will be in the context of a bellows, specifically a folding bellows, it will be noted that other resilient members can be used in the same or similar fashion. The use of bellows is believed to advantageously provide support and the desired movement while reducing or eliminating accessible pinch points compared to the use of at least some of the alternative structures that can be used. In addition, as mentioned above, the use of bellows 128 can provide a desired rate of recovery and a desired amount of compressibility.

Preferably, the bellows have an undulating cross section with two recesses 129 formed along the axial length of the bellows 128. Other numbers of recesses 129 along the axial length of the bellows 128 can be used. For example, a single recess 129 can be positioned along the axial length of the bellows 128 or more than two recesses 129 can be positioned along the axial length of the bellows 128. The recesses 129 provide a limited amount of axial compression of the bellows 128. In some embodiments, each of the illustrated recesses 129 provides ¼ inch of travel. In some embodiments, each of the illustrated recesses 129 provides between ⅛ inch of travel and ⅜ inch of travel. In some embodiments, the recesses 129 each provides the same amount of travel. In some embodiments, one or more of the recesses 129 provides more travel than at least one other recess 129. In some embodiments, three recesses provide ¾ inch of travel for the bellows 128. In some embodiments, multiple recesses provide ¾ inch of travel for the bellows 128. In some embodiments, the bellows has available axial travel of between ½ inch and 1½ inches. When the recesses fully close, the material of the bellows 128 itself can provide a small degree of travel as well, mainly as a way to soften or dampen the end of the travel.

In some embodiments, the first plate 120 is supported from below by one or more resilient members that take the form of a first bellows 130, a second bellows 132, a third bellows 134, and a fourth bellows 136. While four bellows 130, 132, 134, 136 are illustrated, other numbers of bellows also can be used. For example, as few as one bellows, two bellows, or three bellows or more than four bellows can be used. The use of four bellows provides an advantage in reducing costs while providing a desired degree of support in regions where support is desired. By placing the four bellows symmetrically about a wobble axis or center point, the first plate 120 can wobble in almost every direction with similar ease provided that the spring constants of each of the bellows 130, 132, 134, 136 is generally the same. By simply reducing the lateral distance relative to the front-to-rear distance between the bellows, the ability to wobble side-to-side relative to front-to-back is increased provided that the spring constant of each of the bellows is generally the same. Accordingly, placement of the bellows can impact the type of or pattern of wobbling movement. Additionally, changing the spring constant of the bellows relative to each other or one another can impact the ease of wobbling in any particular direction.

Figure 11A:
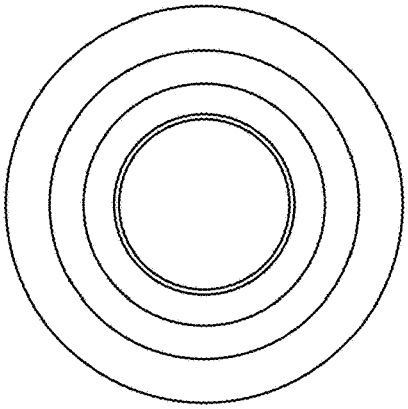
FIGS. 11A-11C show three views of one embodiment of a bellows that can be used with the chair of FIG. 1.
Figure 11B:
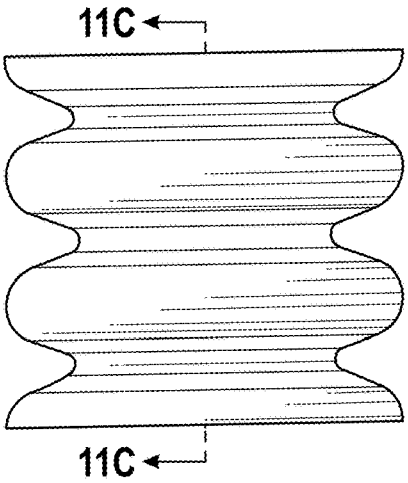
Figure 11C:
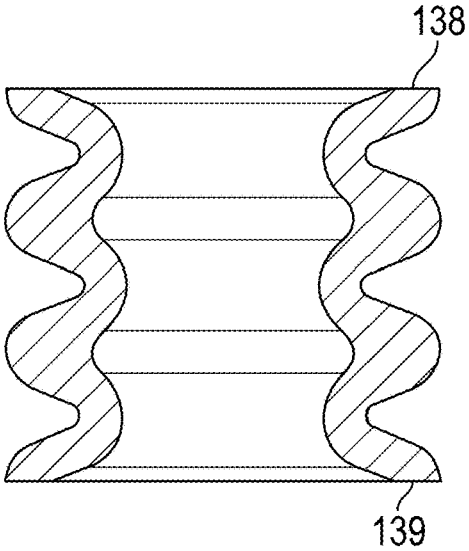
Figure 12:
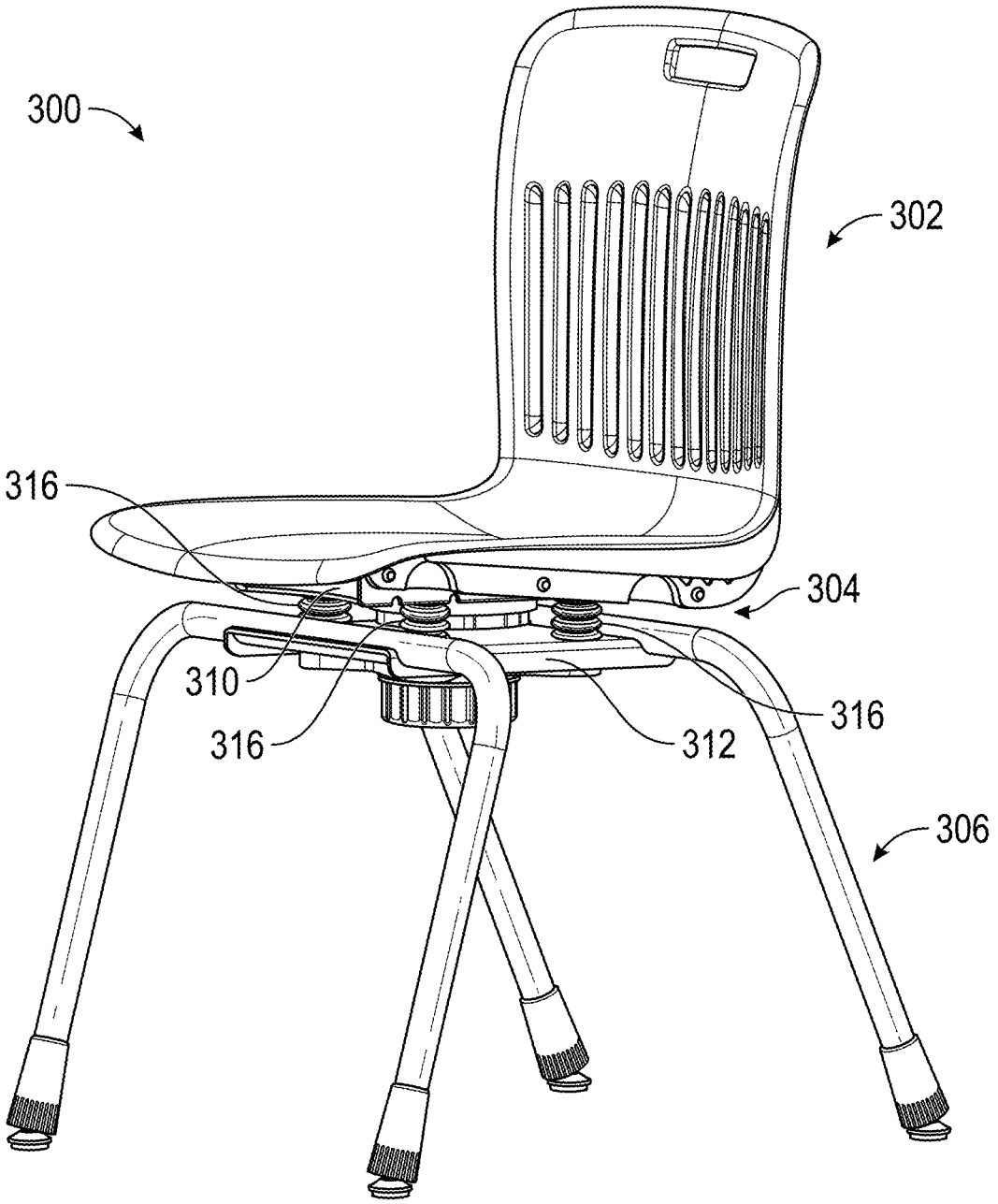
FIG. 12 is a perspective view of another chair that is arranged and configured in accordance with certain features, aspects, and advantages of the present disclosure.

With reference now to FIGS. 11A-11C, each of the bellows 130, 132, 134, 136 has a first bellows end 138 and a second bellows end 139. The first bellows end 138 of each of the bellows is configured to be coupled to, bear against and/or abut the first plate 120 and the second bellows end 139 of each of the bellows is configured to be coupled to, bear against, and/or abut the second plate 122. As such, the bellows 130, 132, 134, 136 are sandwiched between the first plate 120 and the second plate 122. In some configurations, the bellows 130, 132, 134, 136 are positioned between the first plate 120 and the second plate 122 with the ends 138, 139 spaced apart from the first plate 120 and/or the second plate 122 by an intervening member. In the illustrated configuration, because the bellows 130, 132, 134, 136 bear against the first plate 120 and the second plate 122, a cleaner aesthetic appearance and fewer pinch points are created.

In some embodiments, the bellows 130, 132, 134, 136 are made of an elastomeric material, such as nitrile. Nitrile can be used because it exhibits resistance to permanent deformation or set. In some embodiments, the bellows 130, 132, 134, 136 are made of Ethylene-Propylene-Diene Modified (EPDM). EPDM can be used because it exhibits exceptionally good resistance to weather aging, ozone, UV exposure, water, heat, and other environmental conditions. Preferably, the bellows are formed of a material having a durometer between 50 Shore A and 80 Shore A. In some configurations, the bellows are formed of a material having a durometer of 70 Shore A. The bellows 130, 132, 134, 136, however, can be made of other materials taking into account the desired characteristics and anticipated environment of use.

In some embodiments, and as shown in FIG. 9, the intermediate support component 104 also comprises a first rod 140, a second rod 142, a third rod 144, and a fourth rod 146. The reference numbers 140 and 144 for the first rod 140 and the third rod 144 are not shown in the figures, but, have the same structure as that of the second rod 142 and the fourth rod 146 illustrated in FIG. 9. The rods form at least a portion of a motion range limiter. In some such embodiments, the first rod 140, the second rod 142, the third rod 144, and the fourth rod 146 are at least partially contained within, enclosed by, enveloped by, or surrounded by the first bellows 130, the second bellows 132, the third bellows 134, and the fourth bellows 136, respectively. For this reason, the number of rods 140, 142, 144, 146 preferably corresponds to the number of bellows 130, 132, 134, 136. Each rod 140, 142, 144, 148 has a first rod end 147 and a second rod end 149 (see FIG. 9, for example). The first rod end 147 of each rod can be secured to the first plate 120. The second rod end 149 of each rod can coupled to the second plate 122 in such a manner as to allow the rod to be moved axially relative to the second plate 122 (or the plate to move axially along to the rod) but not laterally to any appreciable extent. In some configurations, the rods are coupled to the first and second plates 120, 122 such that the rods limit or define a full range of motion of the first and second plates 120, 122 away from each other. The rods can be coupled to the plates such that the plates 120, 122 can have significantly greater movement toward and away from each other when compared to sliding or rotational movement relative to each other. Of course, the rods allow for relative wobbling movement between the first plate and the second plate. In some embodiments, no or only functionally insignificant sliding or translation is possible between the two plates 120, 122. As used herein, "functionally insignificant" means that some sliding or translation is possible but that such sliding or translation does not impact the main purpose of being restrained against sliding or translation (e.g., sliding or translation caused by tolerance stackups or slightly oversized openings).

Figure 8:
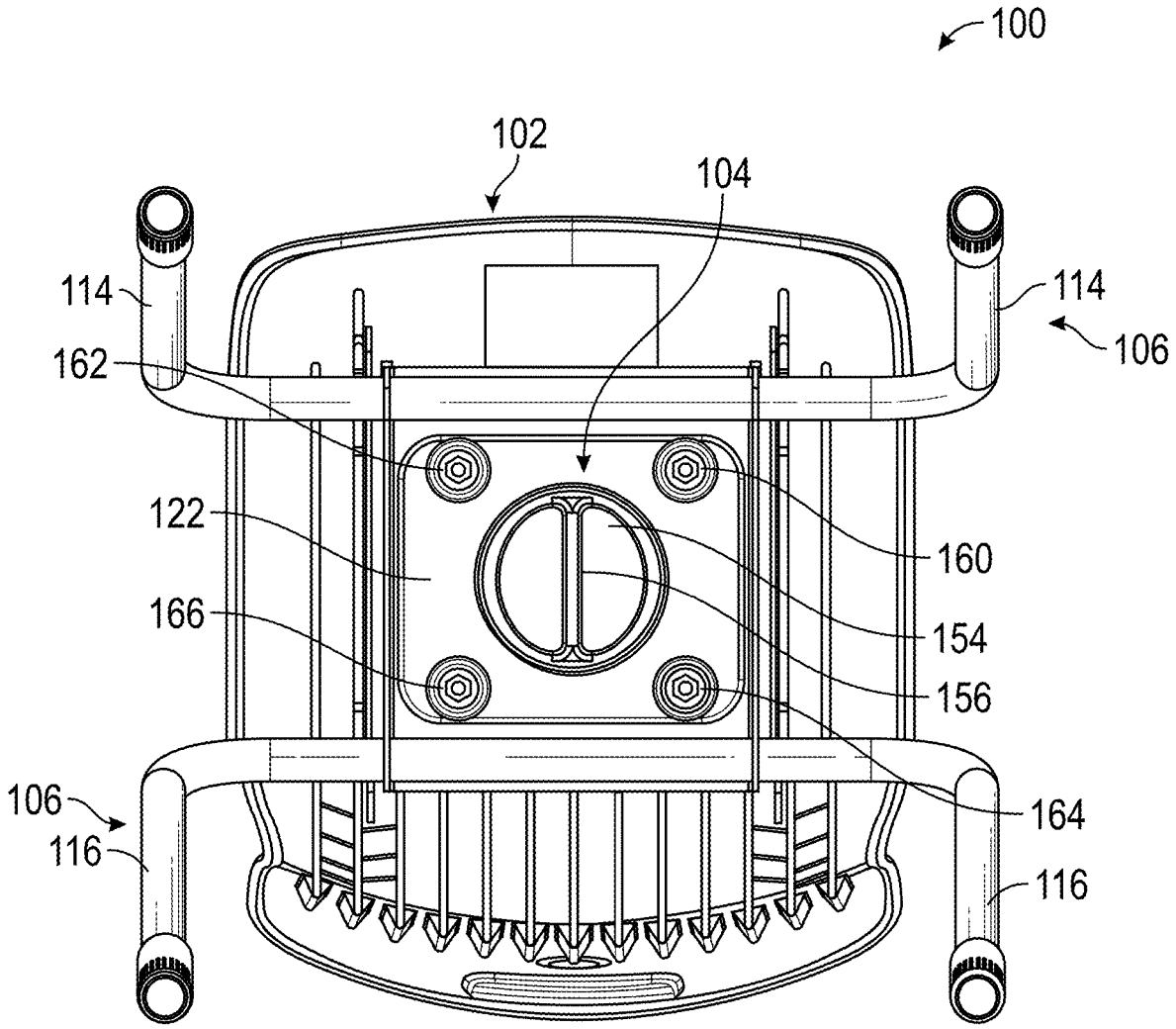
FIG. 8 is a bottom view of the chair of FIG. 1.

FIG. 9 shows a cross-sectional view of the second bellows 132 and the fourth bellows 136. As shown in FIG. 9, the second rod 142 is at least partially contained within the second bellow 132, and the fourth rod 146 is at least partially contained within the fourth bellow 136. The first rod end 147 of each of the second rod 142 and the fourth rod 146 is secured to the first plate 120. The rods 142, 146 can be secured to the first plate 120 via a threaded nut, a threaded weld nut, or other suitable hardware. The second rod end of each of the second rod 142 and the fourth rod 146 is coupled to the second plate 122 as shown in FIG. 9. As shown in FIG. 9, the second rod 142 is coupled to the second plate 122 via a second cavity 162 in second plate 122, and the fourth rod 146 is coupled to the second plate 122 via a fourth cavity 166 in the second plate 122. The cavities 162, 166 can be defined by one or more separate members from the second plate 122 or can be integrally formed with the second plate 122. The cavities define a chamber in which a head of the threaded member (e.g., second end 149 of the rods) can translate. Desirably, the head of the threaded member does not exit the associated cavity at any point in the full range of travel. In some configurations, the threaded member does not have any portion that emerges from the open end of the cavity at any point in the full range of travel. In some configurations, the cavities are enclosed and the threaded member is captured within the cavity. Although not shown in FIG. 9, each of the first rod 140 and the third rod 144 are coupled to the first plate 120 and the second plate 122 in similar fashion. For example, each of the first rod 140 and the third rod 144 is secured to the first plate 120 via a threaded nut or other suitable hardware. Moreover, the first rod 140 is coupled to the second plate 122 via a first cavity 160, and the third rod 144 is coupled to the second plate 122 via a third cavity 164. FIG. 8 shows the cavities 160, 162, 164, 166 as viewed from the bottom of the chair 100. The cavities, which are defined by sleeve-like components in the illustrated configuration can shield movement of the second ends of the rods and generally obscure the second ends from sight. Other configurations also are possible. In some configurations, the rods can be coupled to the second plate and have an end that moves relative to the first plate. In such configurations, because the moving end is retained between the seat and the first plate, the cavities may be omitted.

The second rod end of each of the rods 140, 142, 144, 146, and the opening of each of the cavities 160, 162, 164, 166 closest to the first plate 120, are configured such that each of the rods 140, 142, 144, 146 can be moved axially but not laterally to any appreciable extent or to allow only functionally insignificant lateral movement. For example, with reference to FIG. 9, when a downward force is applied to the seat portion 110 such that the bellows 132, 136 are compressed, the rods 142, 146 move axially downward but do not move laterally to any appreciable extent. (Note, however, that in FIG. 9 the motion control mechanism is actually shown as being engaged. Therefore, the seat portion 110 would be in a locked position and the rods 140, 142, 144, 146 could not move laterally or axially to any appreciable extent or to only a functionally insignificant degree.) Allowing the rods 140, 142, 144, 146 to move axially but not laterally provides stability to the seat portion 110 while still allowing the seat portion 110 to be tilted in all directions. In some embodiments, up to 8 degrees of movement are provided in each direction. In some embodiments, between 5 and 11 degrees of movement are provided in at least the front, back, left, and right directions. In some embodiment, 6 to 10 degrees of movement in these directions is provided.

With reference to FIGS. 8 and 9, the intermediate support component 104 comprises a motion control mechanism 200. In the illustrated configuration, the motion control mechanism 200 can limit, restrict, or prevent movement of the first plate 120 relative to the second plate 122. The illustrated motion control mechanism 200 comprises a portion of the second plate 122 as well as a stop element 150. In the illustrated embodiment, the stop element 150 is generally cylindrical (i.e., at least a portion or, in some cases a majority of, the element is cylindrical) and has an external or male screw thread pattern 151. The stop element 150 has a first portion 152 and a second portion 154. In the illustrated embodiment, the second plate 122 comprises a hole or passage with an internal or female screw thread pattern 155 that matches or corresponds to the external or male screw thread pattern 151 of the stop element 150. Accordingly, the stop element 150 can be threaded into the hole of the second plate such that the first portion 152, which can define an end surface of the stop element 150, can be moved up and down relative to the second plate 122.

With reference still to FIGS. 8 and 9, the first portion 152 of the stop element 150 can be generally flat and the second portion 154 of the stop element 150 can comprise a ridge or grip 156 that enables the stop element 150 to be easily rotated. In other embodiments, the first portion 152 of the stop element 150 can have a concave region or a convex region. Such regions would result in less surface contact between the first portion 152 and the first plate 120. Other configurations also can be used to lessen the surface contact between the first portion 152 and the first plate 120. Less surface contact reduces the likelihood of binding when the first portion of the stop element 150 abuts with the first plate 120. In some embodiments, the second surface 154 of the stop element 150 can comprise grooves, recesses, protrusions, wings, knurling, or other configurations that can be suitable for enabling the stop element 150 to be easily rotated. Other suitable embodiments are also possible.

In the illustrated embodiment, the motion control mechanism 200 can be used to lock the seat portion 110 of the seat component 102 in place, such that the seat portion 110 cannot be moved or tilted to any appreciable extent or such that the seat portion 110 is limited to functionally insignificant movement in ordinary use. To engage the motion control mechanism 200, the stop element 150 is threaded into the hole of the second plate 122 until the first portion 152 of the stop element 150 contacts the first plate 120, at which point further rotation of the stop element 150 is precluded. To disengage the motion control mechanism 200, the cylindrical piece 150 can be unthreaded from the hole of the second plate 122 such that the first portion 152 of the stop element 150 moves a distance away from the first plate 120. Up to a certain point, the further the first portion 152 of the stop element 150 is moved away from the first plate 120, the more the seat portion 110 of the seat component 102 can be tilted or moved.

The motion control mechanism 200 increases or facilitates the ability of the chair 100 to be used with individuals having differing needs. In particular, given that the chair 100 comprises the seat portion 110 that is configured to be movable or tiltable in all directions, without the motion control mechanism engaged, the chair meets the needs of a population seeking greater freedom of movement when using a chair. With the motion control mechanism engaged, the seat portion 110 of the chair 100 can be rigidly locked or secured such that the seat portion 110 of a chair 100 in the stack will not move or tilt in any functionally significant manner under ordinary conditions, which will meet the needs of a certain population that can become easily distracted or could distract others when seated in a movable chair. The structure of the motion control mechanism is also such that the motion control mechanism does not thwart the ability to easily stack the chairs into a stable grouping of the chairs.

With reference now to FIGS. 12-18, another chair 300 that is arranged and configured in accordance with certain features, aspects and advantages of the present disclosure will be described. Many of the features, aspects, and advantages of the embodiment of FIGS. 12-18 are similar to the embodiment of FIGS. 1-11. Accordingly, the following description focuses upon another embodiment of an intermediate support 304 that interconnects a seat 302 and legs 106. The seat and legs can be configured as described above.

The intermediate support 304 comprises a first plate 310, which is the upper plate, and a second plate 312, which is the lower plate. The first plate 310 is fixed, joined, coupled, or integrally formed with the seat 302. The first plate 310 is positioned entirely underneath the seat 302. In some configurations, the first plate 310 is concealed by the seat 302.

Figure 13:
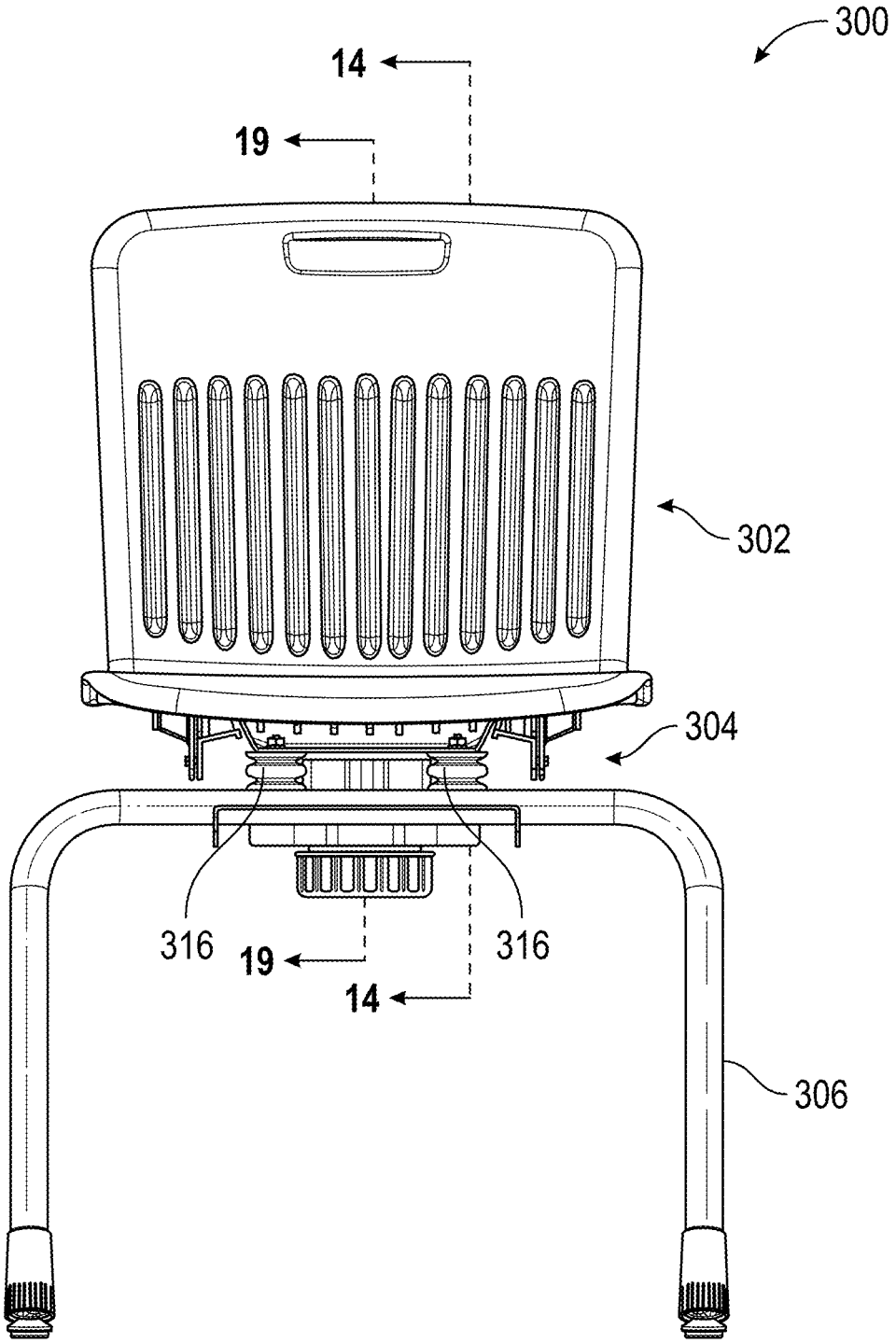
FIG. 13 is front elevation view of the chair of FIG. 12.

The second plate 312 is fixed, joined, coupled, or integrally formed with the legs 306. The second plate 312 can be positioned atop, underneath or can intersect with the legs 306. In some configurations, the second plate 312 comprises recesses or slots 314 (see FIG. 16) that receive the legs 306. The legs 306 can be secured in position relative to the slots 314 using any suitable technique, including but not limited to welding. As illustrated in FIG. 13, the legs 306 obscure at least a portion of the intermediate support 304.

Figure 14:
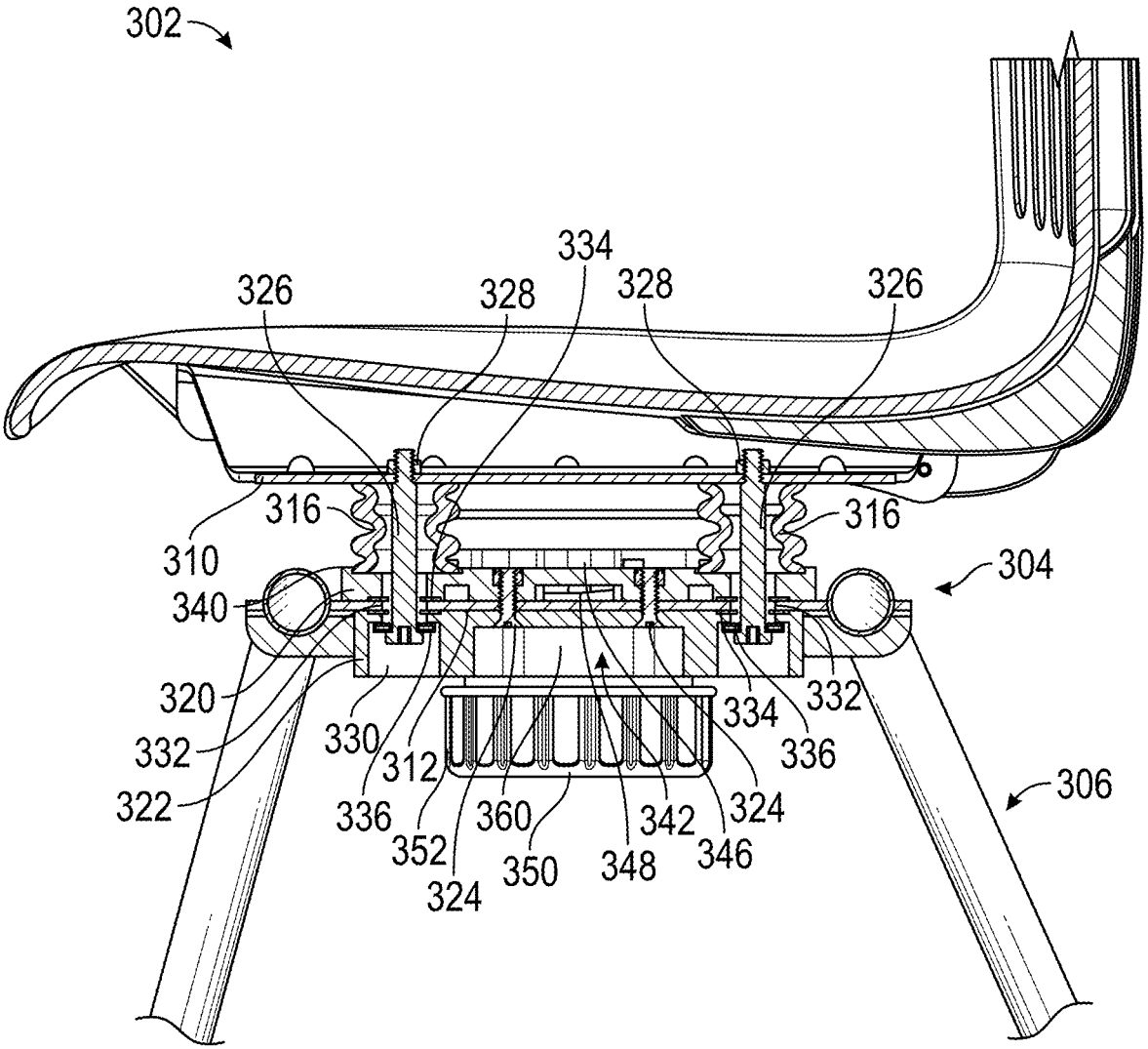
FIG. 14 is a side sectioned view of the chair of FIG. 12 taken along the line 14-14 in FIG. 13.

The first plate 310 and the second plate 312 are vertically spaced apart from each other, as shown in FIG. 14. Because the second plate 312 is fixed relative to the legs 306 (and therefore the ground) and the first plate 310 is fixed relative to the seat 302, movement of the first plate 310 relative to the second plate 312 will cause movement of the seat 302. Preferably, the first plate 310 is capable of wobbling movement in 360 degrees of directions relative to the second plate 312 as described above. In some configurations, the first plate can move in more than four directions (i.e., more than front, back, left, and right). As with the embodiment above, up to 8 degrees of movement are provided in each direction. In some embodiments, between 5 and 11 degrees of movement are provided in at least the front, back, left, and right directions. In some embodiment, 6 to 10 degrees of movement in these directions is provided.

As described above, bellows 316 are provided to provide controlled movement between the two plates 310, 312. While bellows are illustrated, any suitable elastic body or device that recovers its original shape after being distorted or that is elastically deformed during use can be used. The bellows 316 can be spaced to provide a desired movement. In the illustrated configuration, the bellows 316 are spaced symmetrically with two bellows 316 in a forward portion and two bellows 316 in a rearward position. As such, centers of the bellows 316 define a square when viewed from above (i.e., see FIG. 16). As shown in FIG. 14, the bellows on the left side are aligned in a front to back direction with the bellows on the right side. As shown in FIG. 13, the bellows on the front side are aligned in a right to left direction with the bellows on the back side.

With reference again to FIG. 14 and FIG. 15, an upper mounting plate 320 and a lower mounting plate 322 are shown coupled to the second plate 312. While the first and second plates 310, 312 can be formed of metal or another rigid material, the upper mounting plate 320 and the lower mounting plate 322 can be formed of a moldable material. In the illustrated configuration, the upper and lower mounting plates are plastic. The upper and lower mounting plates 320, 322 can be secured together or separately secured to the second plate 312 in any suitable manner. In some configurations, the upper and lower mounting plates are secured together using a plurality of threaded fasteners 324.

As described above, the bellows 316 are secured in position generally between the first plate 310 and the second plate 312 by rods or shoulder bolts 330. As shown in FIG. 14, the shoulder bolts 330 have a threaded end that engages weld nuts or nuts 328. The nuts 328 and the shoulder of the shoulder bolts 330 secure the shoulder bolts 330 against any functionally significant axial movement relative to the first plate 310. The lower end of the shoulder bolts 330 pass through oversized openings 332 in the second plate 312. The oversized openings 332 are designed to receive grommets 334. The grommets preferably comprise a rubber material with an oversized opening relative to the size of the shoulder bolts 326. The material of the grommets 334 reduces or eliminates the likelihood of noise being created should pivoting movement of the shoulder bolt relative to the first plate 310 cause a side of the shoulder bolt 326 to engage the grommet 334. Additionally, a suitable washer 336 can be positioned between the head of the shoulder bolt 326 and the closed end of the recesses 330 formed in the lower mounting plate. The washer 336 in some configurations is rubber-coated such that the washer can damped the sound and energy associated with the head of the shoulder bolt 326 contacting the closed end of the recess 330. As described above, the head of the shoulder bolt 326 translates within the recess 330. Preferably, the head of the shoulder bolt 326 does not emerge from the recess 330 even at the extreme end of the range of travel of the head of the shoulder bolt 326.

The upper mounting plate 320 comprises shallow locating recesses 340 for the bellows 314. The locating recesses encircle a lower end of the associated bellows 316. The locating recesses 340 can help to further reduce the likelihood of pinch regions and can provide an aesthetically pleasing appearance to the region in which the bellows 316 abuts the upper mounting plate 320.

The intermediate support 304 also comprises a motion control mechanism 342. While the embodiment described above included a motion control mechanism 200 that allowed some variability in the movement experienced, the motion control mechanism 342 in this embodiment is designed to be locked or unlocked with no variability in the movement experienced. With reference now to FIGS. 15-20, the motion control mechanism 342 generally comprises an actuator 344 that is joined to one or more wedge blocks 346.

The wedge blocks 346 are sized and arranged to sandwich themselves between the first plate 310 and the upper mounting plate 320. In the illustrated configuration, the lower surface of at least one of the wedge blocks 346 (and preferably each of the wedge blocks 346) comprises an inclined surface 348 (see FIG. 14). As will be described below, the wedge blocks 346 are rotated into an engaged position. When viewed from the bottom, the actuator 344 is rotated clockwise to lock. The slope of the inclined surface 348 is such that, as the actuator 344 is rotated clockwise to clock, the wedge block 346 increases in height. Accordingly, when the wedge blocks 346 are fully engaged with the first plate 310 and the upper mounting plate 320, the first plate 310 is secured against any functionally significant movement relative to the second plate 312. In some configuration, the first plate can have a sloping surface and/or the upper mounting plate can have a sloping surface such that the inclined surface 348 of the wedge block can be omitted. The wedge block 346 is placed in compression between the first plate 310 and the second plate 312 (through the intervening upper mounting plate 320). In some configurations, the wedge blocks can directly engage the second plate 312. In some configurations, the wedge blocks can engage an intermediate member between the wedge blocks and the first plate. In some configurations, there is only one wedge block. In some configurations, there are multiple wedge blocks. In some configurations, there are four wedge blocks. In some configurations, the four wedge blocks are symmetrically disposed about a rotational axis of the actuator 344.

Figure 15:
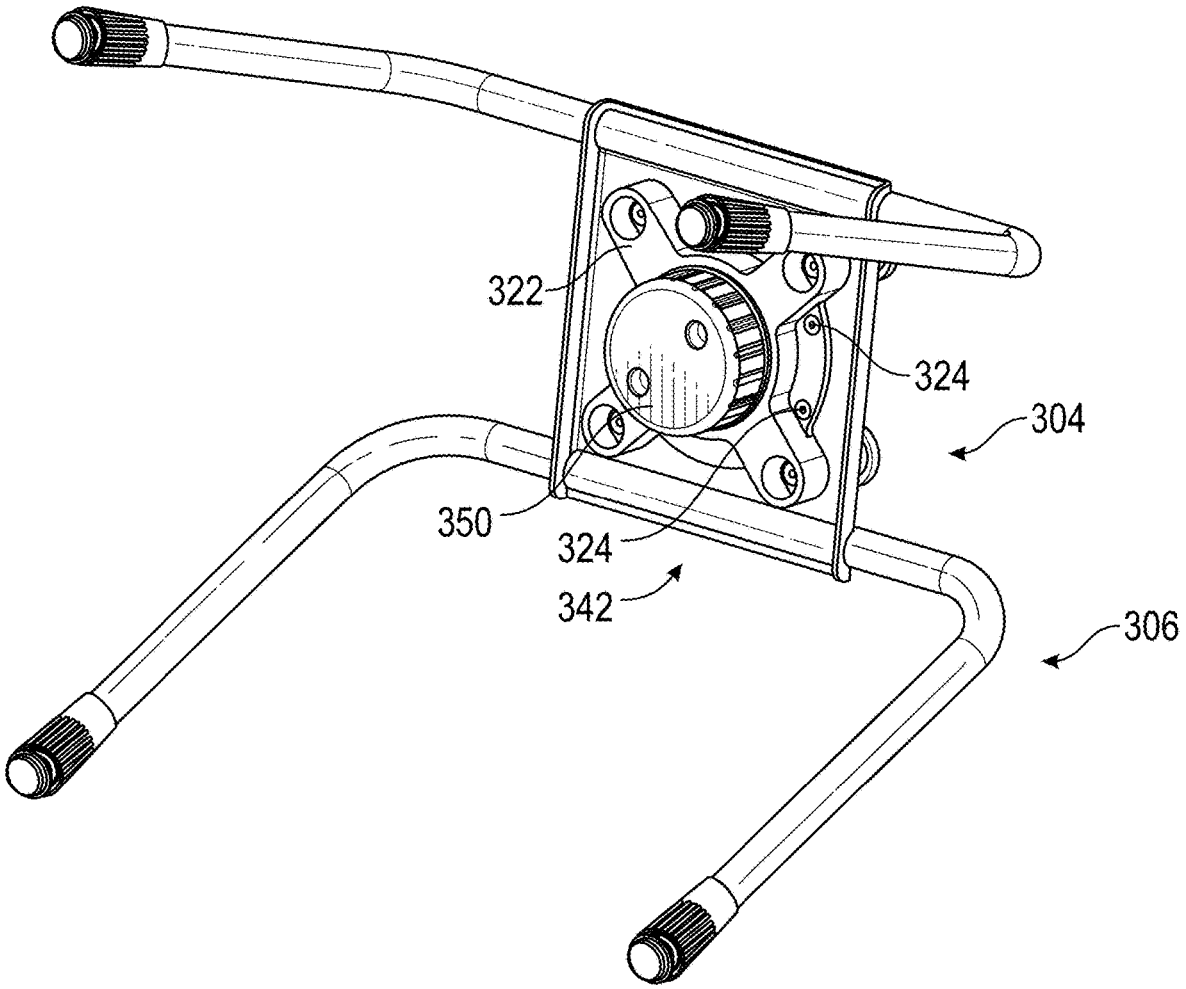
FIG. 15 is a bottom side perspective view of the chair of FIG. 12 showing a portion of a locking mechanism.

The actuator 344 comprises a handle 350, which is best shown in FIGS. 14 and 15. The handle 350 can have any suitable shape or configuration keeping in mind a desire to provide ease of controlled movement of the actuator 344 and the wedge blocks 346. In the illustrated configuration, the handle 350 can have a generally cylindrical side surface 352 with gripping aids 354 disposed along at least a portion of the cylindrical side surface 352 and with a circular bottom surface 356. Instructive indicia can be provided on one or more of the side surface 352 and the bottom surface 356. In the illustrated configuration, the instructive indicia can be arrows. The illustrated instructive indicia are on the bottom surface 356.

The handle 350 is connected to a shaft 360. The shaft interconnects the handle 350 and the wedge blocks 346. In some configurations, the shaft 360 is integrally formed with at least one of the handle 350 and the wedge blocks 346. In the illustrated configuration, the shaft 360 is integrally formed with the wedge blocks 346 and the handle 350 is attached to the integrated shaft 360 and wedge blocks 346 with threaded fasteners. Other configurations are possible.

Figure 19:
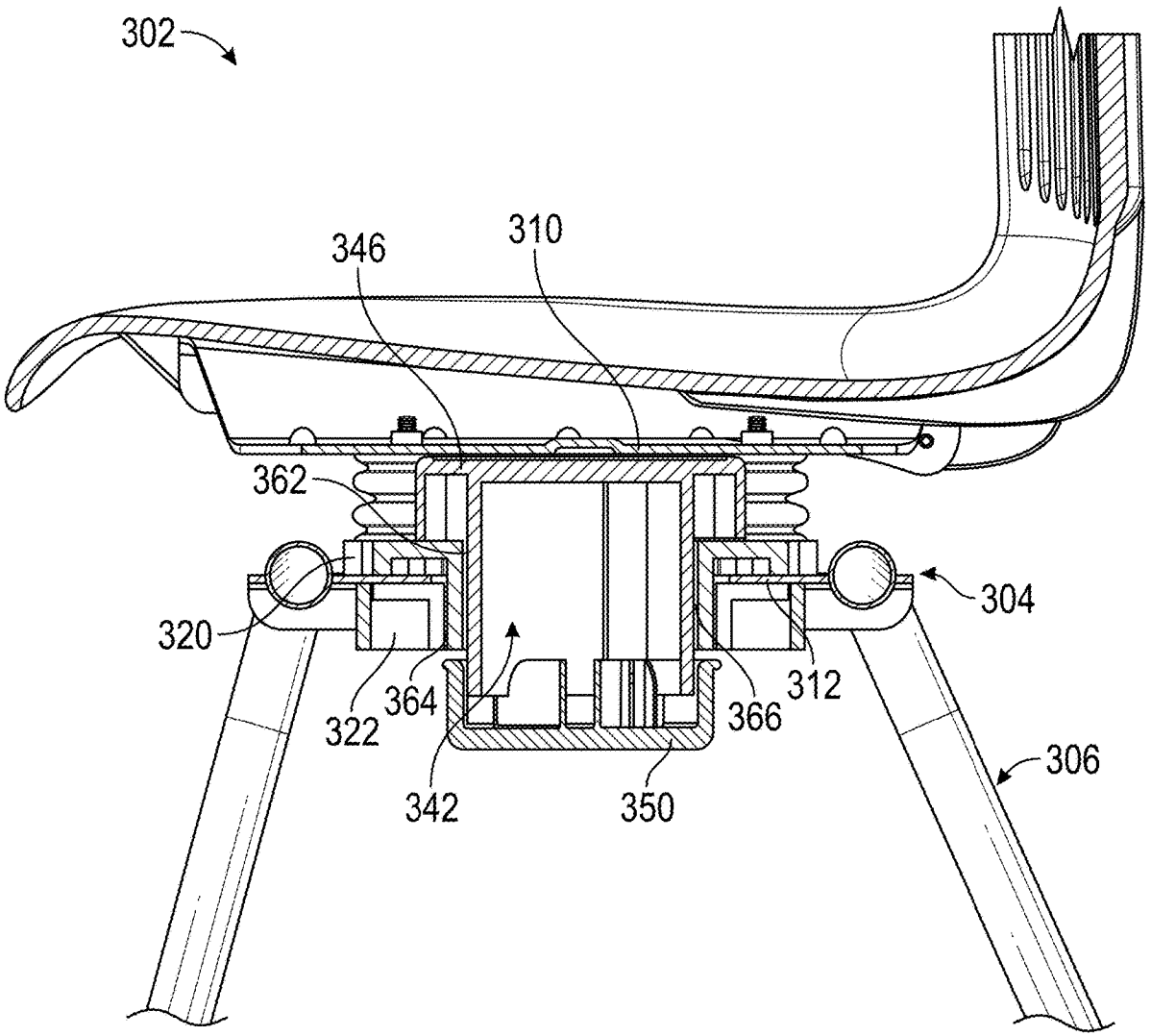
FIG. 19 is a sectioned side view of the chair of FIG. 12 taken along the line 19-19 in FIG. 13 and showing the locking system in the locked position.
Figure 20:
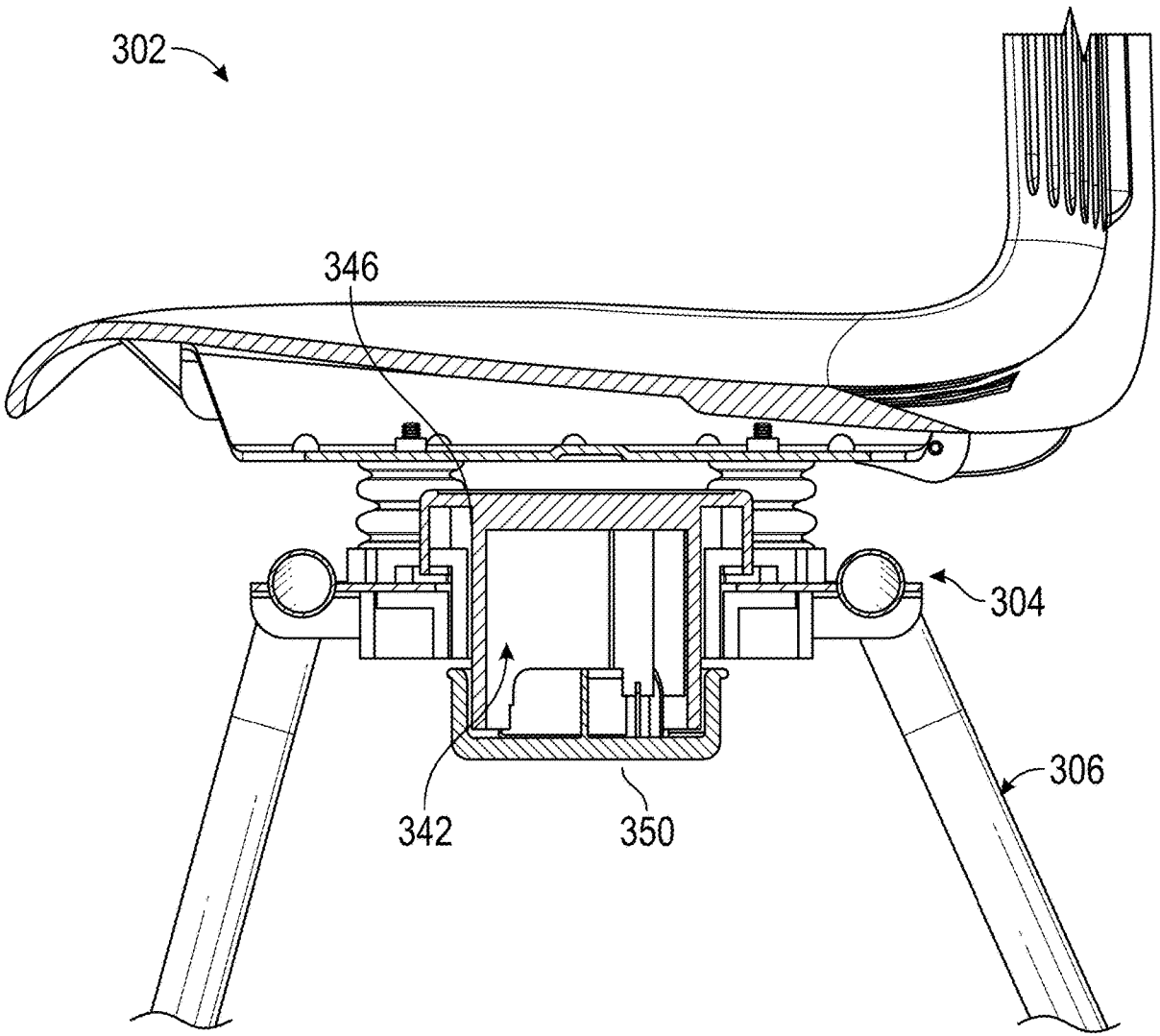
FIG. 20 is a sectioned side view of the chair of FIG. 12 taken along the line 19-19 in FIG. 13 and showing the locking system in the locked position.

As shown in FIG. 19, a passageway 362 is defined through the second plate 312, the upper mounting plate 320, and the lower mounting plate 322. The shaft 360 extends through the passageway 362 such that the wedge blocks 346 are positioned above the second plate 312 and such that the handle 350 is positioned below second plate 312. In the illustrated embodiment, the lower mounting plate 322 defines an opening 364 and the upper mounting plate 320 also defines an opening 366. The structure that defines the opening 366 in the upper mounting plate 320 extends downwardly through an opening in the second plate and into the opening 364 defined by the lower mounting plate 322. The handle 350 preferably is larger in diameter than (or at least has larger structures relative to) the opening 366 defined by the upper mounting plate 320 such that the handle 350 cannot pass through the opening 364. Other configurations are possible because the upward movement of the actuator 344 will be limited by the first plate 310. However, by having the handle 350 bottom against one or more of the upper mounting plate 320 and the lower mounting plate 322, movement of the actuator 344 in an upward direction can be limited to a desired height at which the top of the actuator 344 is not forced against the first plate 312 prior to beginning the rotation of the wedge blocks 346 toward the locked position. Such a configuration improves the functionality of the actuator 344. Other types of handles, including levers, radially extending rods, handgrips, or the like can be used in place of the handle or in addition to the handle.

Figure 16:
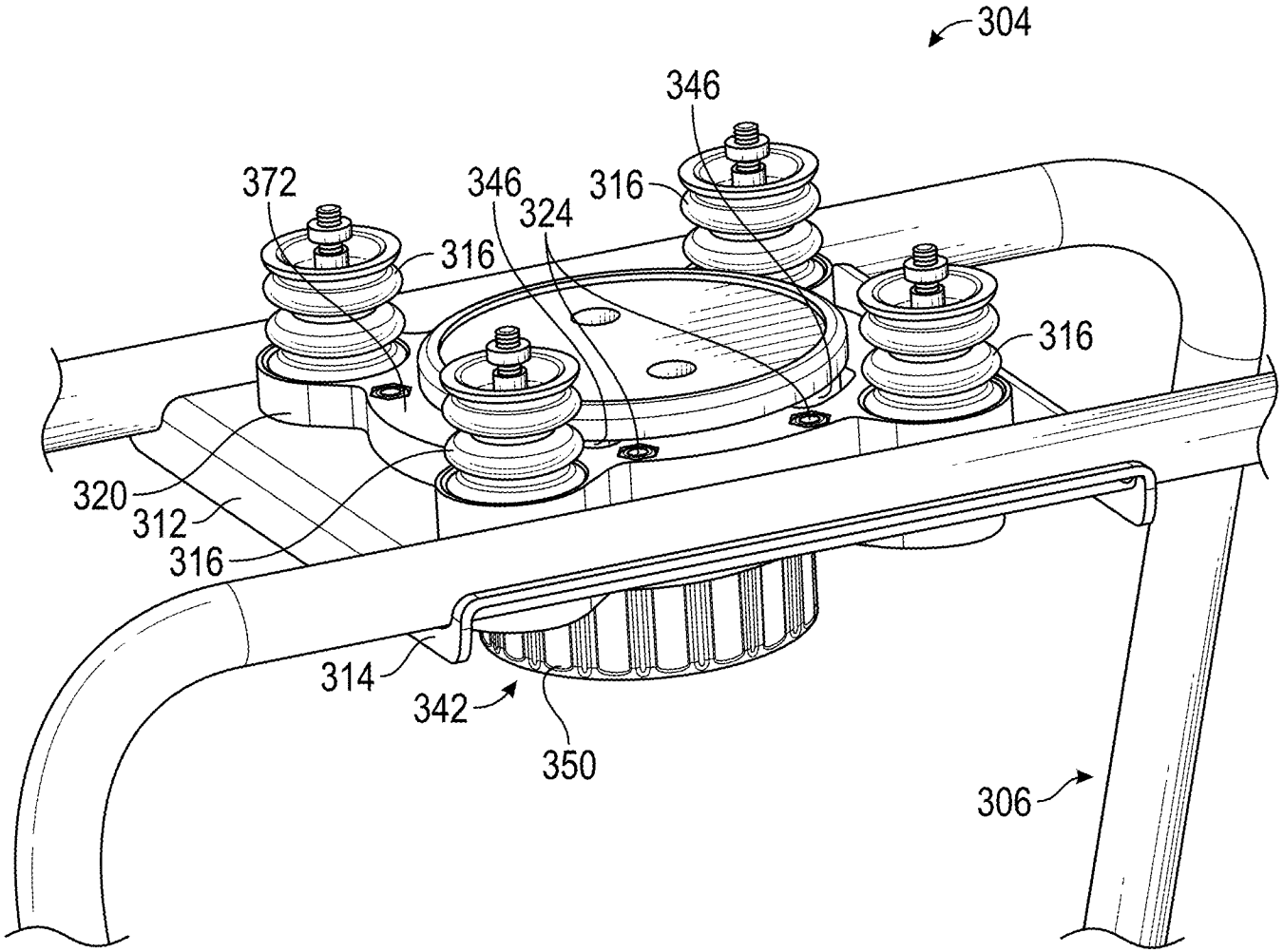
FIG. 16 is an enlarged perspective view of a portion of the chair of FIG. 12 with the seat and the top plate shown removed and the locking mechanism in an unlocked position.
Figure 17:
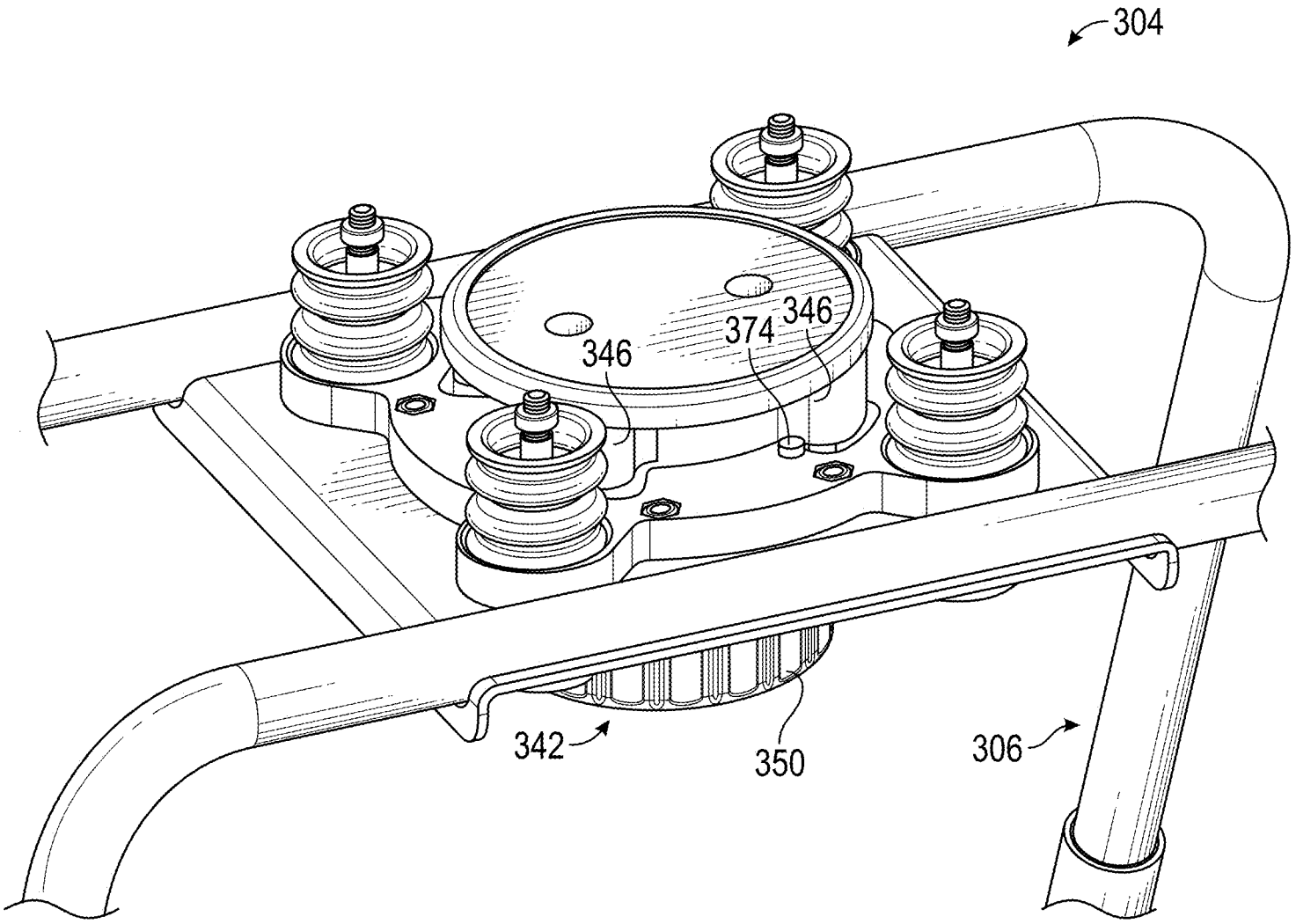
FIG. 17 is another enlarged perspective view of the portion of the chair of FIG. 12 with the locking mechanism in a raised position.
Figure 18:
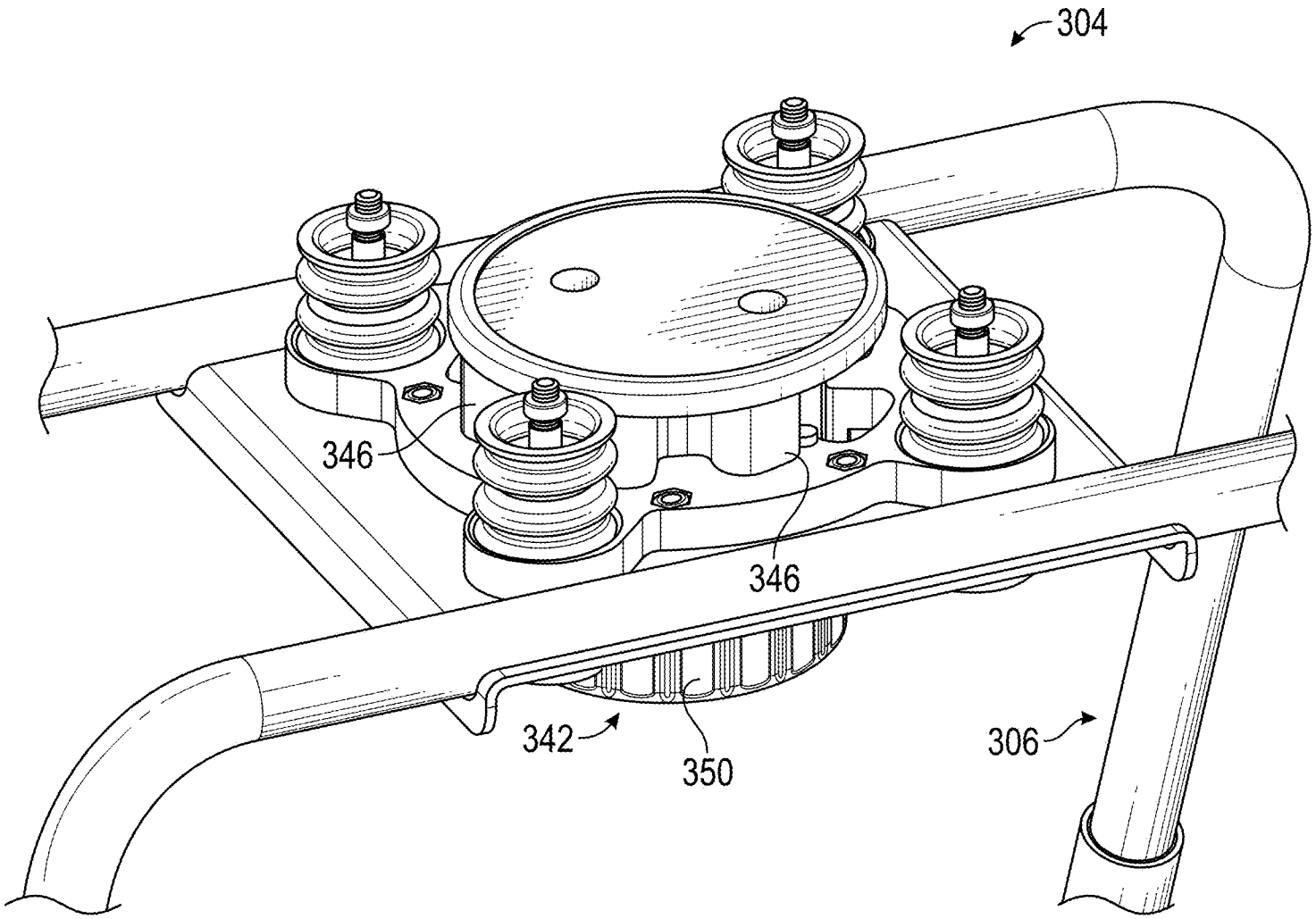
FIG. 18 is an additional enlarged perspective view of the portion of the chair of FIG. 12 with the locking mechanism in the raised position and fully rotated to the locked position.

With reference now to FIGS. 16-18, in the illustrated configuration, the upper mounting plate 320, the lower mounting plate 322, and the second plate 312 define one or more sockets 370. The sockets 370 extend through at least a portion of the upper mounting plate 320 and at least a portion of the lower mounting plate 322. In some configurations, the sockets 370 only extend through the upper mounting plate 320. In some configurations, the sockets 370 extend fully through the upper mounting plate 320 and only partially through the lower mounting plate 322.

The sockets 370 are configured to receive the wedge blocks 346. Accordingly, there preferably are as many sockets 370 as there are wedge blocks 346. In some configurations, there may be more sockets 370 than wedge blocks 346. The sockets 370 preferably are oversized in width compared to the width of the wedge blocks 346. By oversizing the sockets 370 relative to the wedge blocks 346, the wedge blocks 346 are less likely to bind within the sockets 370. Other configurations to reduce the likelihood of binding also can be used.

The sockets 370 extend downward from a surface 372 of the upper mounting plate 320. The upper mounting plate 320 also comprises at least one stop 374. The stop 374 projects from the surface 372. In the illustrated embodiment, the surface 372 is an upper surface and the at least one stop 374 projects upward from the upper surface 372. The stop 374 is positioned between adjacent sockets 370. In some configurations, there are stops 374 positioned between each pair of adjacent sockets 370. In some configurations, the stop 374 is positioned adjacent to one side of the socket 370. In some configurations, one stop 374 adjoins one side of each of the sockets 370. The stop 374 limits a range of movement of the wedge block 346. For example, the stop 374 is designed to limit the travel of the wedge block 346 away from the socket 370 during the locking movement and the stop is designed to stop travel of the wedge block 346 such that the wedge block 346 is aligned with the socket 370 during unlocking movement. In other words, two opposing sides of the same stop 374 can be used to stop wedge block movement in two different directions. In some configurations, separate members or stops can be provided to limit movement in the two different directions. In some configuration a stepped recess in the surface 372 can be used to define the stop. In addition, in some configurations, a tab, bump, other member can be used to provide tactile or audible feedback indicative of the wedge block being moved to the fully locked position. Such an indicator can be useful to confirm that the actuator has been fully rotated to the locked position.

In use, when the intermediate support 304 is in the unlocked stated and is fully movable, the handle 350 of the actuator 344 of the motion control mechanism 342 can be used to lock the intermediate support 304 against functionally significant movement. The handle 350 can be used to push the actuator 344 upward until the wedge blocks 346 clear the upper ends of the sockets 370. The handle 350 can be rotated and the rotation of the handle is transmitted by the shaft 360 to the wedge blocks 346. As the handle rotates, the wedge blocks 346 move toward the locked position. When the wedge blocks 346 reach the stops 374, the motion control mechanism 342 is in the fully locked state. To unlock the motion control mechanism 342, the handle 350 is rotated in the opposite direction until the wedge blocks 346 reach the stops 374. Once the wedge blocks reach the stops 374, the wedge blocks 346 are aligned with the sockets 370 and the handle 350 can be released. The wedge blocks 346 will fall into the sockets 370 under the force of gravity and the intermediate support 304 is in the unlocked position. In some configurations, a spring can be used to bias the actuator 344 into the downward and unlocked position. Other configurations are possible.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include these features, elements and/or states.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

While the above detailed description may have shown, described, and pointed out novel features as applied to various embodiments, it may be understood that various omissions, substitutions, and/or changes in the form and details of any particular embodiment may be made without departing from the spirit of the disclosure. As may be recognized, certain embodiments may be embodied within a form that does not provide all of the features and benefits set forth herein, as some features may be used or practiced separately from others.

Additionally, features described in connection with one embodiment can be incorporated into another of the disclosed embodiments, even if not expressly discussed herein, and embodiments having the combination of features still fall within the scope of the disclosure. For example, features described above in connection with one embodiment can be used with a different embodiment described herein and the combination still fall within the scope of the disclosure.

It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above. Accordingly, unless otherwise stated, or unless clearly incompatible, each embodiment of this disclosure may comprise, additional to its essential features described herein, one or more features as described herein from each other embodiment disclosed herein.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added.

Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Unless the context clearly requires otherwise, throughout the description and the claims, the words "comprise," "comprising," and the like, are to be construed in an inclusive sense as opposed to an exclusive or exhaustive sense, that is to say, in the sense of "including, but not limited to."

Reference to any prior art in this description is not, and should not be taken as, an acknowledgement or any form of suggestion that that prior art forms part of the common general knowledge in the field of endeavor in any country in the world.

Aspects of the invention of the present disclosure may also be said broadly to consist in the parts, elements and features referred to or indicated in the description of the application, individually or collectively, in any or all combinations of two or more of said parts, elements or features.

Where, in the foregoing description, reference has been made to integers or components having known equivalents thereof, those integers are herein incorporated as if individually set forth. In addition, where the term "substantially" or any of its variants have been used as a word of approximation adjacent to a numerical value or range, it is intended to provide sufficient flexibility in the adjacent numerical value or range that encompasses standard manufacturing tolerances and/or rounding to the next significant figure, whichever is greater.

It should be noted that various changes and modifications to the presently preferred embodiments described herein will be apparent to those skilled in the art. Such changes and modifications may be made without departing from the spirit and scope of the present disclosure and without diminishing its attendant advantages. For instance, various components may be repositioned as desired. It is therefore intended that such changes and modifications be included within the scope of the present disclosure. Moreover, not all of the features, aspects and advantages are necessarily required to practice the present disclosure. Accordingly, the scope of the present disclosure is intended to be defined only by the claims.

What is claimed is:

1. A chair comprising:

a seat component comprising a seat portion with a bottom surface and a back support portion, the seat portion and the back support portion comprising a uniform body;

an intermediate support component joined to the seat component and comprising a first plate and a second plate, the first plate being joined to the bottom surface of the seat portion, the second plate comprising a hole, the first plate and the second plate being spaced apart from each other using a first bellows, a second bellows, a third bellows, and a fourth bellows, and the first plate and the second plate being coupled together using a first rod, a second rod, a third rod, and a fourth rod, each of the first rod, the second rod, the third rod, and the fourth rod being at least partially contained within one of the first bellows, the second bellows, the third bellows, and the fourth bellows, a motion control mechanism that is selectively engagable with the first plate and that extends through the hole of the second plate, wherein the motion control mechanism comprises a stop element and the hole of the second plate comprising a threaded hole, the stop element comprising a first portion, a second portion, and a thread pattern positioned between the first portion and the second portion, the thread pattern enabling the stop element to rotated relative to the threaded hole of the second plate; and a leg component comprising a first pair of legs and a second pair of legs, each of the first pair of legs and the second pair of legs being joined to the second plate.

2. The chair of claim 1, wherein the first portion of the stop element of the motion control mechanism engages the first plate to limit relative movement of the first plate relative to the second plate.

3. The chair of claim 1, wherein the motion control mechanism is disengaged when the first portion of the stop element is not contacting the first plate.

4. The chair of claim 1, wherein the motion control mechanism comprises a handle that is connected to at least one wedge block, the at least one wedge block being movable between a first position within a socket defined within the intermediate support component and a second position that is engaged with the first plate.

5. The chair of claim 1, wherein the first rod, the second rod, the third rod, and the fourth rod are coupled to each of the first plate and the second plate in such manner as to allow the first rod, the second rod, the third rod, and the fourth rod to move axially but not laterally to any appreciable extent when a force is applied to the seat component.

6. A chair having a seat portion that is capable of selective wobbling relative to a leg portion, the seat portion being joined to a first plate and the leg portion being joined to a second plate, the first plate and the second plate being spaced apart by one or more resilient members, the first plate and the second plate having a range of motion that can be locked out by a motion control mechanism, wherein the motion control mechanism comprises a stop element that translates relative to the second plate and the motion control mechanism being positioned at least partially between the first plate and the second plate.

7. The chair of claim 6, wherein a range of motion of the stop element is limited by the first plate.

8. The chair of claim 7, wherein the stop element comprises a first threaded surface and the second plate comprises a second threaded surface, the first threaded surface and the second threaded surface cooperating together to guide movement of the stop element relative to the second plate.

9. The chair of claim 7, wherein the stop element comprises a first portion that contacts the first plate.

10. The chair of claim 9, wherein the stop element also comprises a second portion configured to be grasped by a user for manipulating the stop element in a rotational direction.

11. The chair of claim 6, wherein at least one limiter member is connected to the first plate and the second plate such that movement of the first plate and the second plate away from each other is limited.

12. The chair of claim 11, wherein a first end of the limiter member is fixed relative to the first plate and a second end of the limiter member is movable relative to the second plate.

13. The chair of claim 12, wherein each of the one or more resilient members comprise a bellows that is positioned between the first plate and the second plate.

14. The chair of claim 13, wherein the limiter member is a rod that extends through the bellows.

15. A chair comprising:

a seat component comprising a seat portion with a bottom surface and a back support portion, the seat portion and the back support portion comprising a uniform body;

an intermediate support component joined to the seat component and comprising a first plate and a second plate, the first plate being joined to the bottom surface of the seat portion, the second plate comprising a hole, the first plate and the second plate being spaced apart from each other using a first bellows, a second bellows, a third bellows, and a fourth bellows, and the first plate and the second plate being coupled together using a first rod, a second rod, a third rod, and a fourth rod, each of the first rod, the second rod, the third rod, and the fourth rod being at least partially contained within one of the first bellows, the second bellows, the third bellows, and the fourth bellows, a motion control mechanism that is selectively engagable with the first plate and that extends through the hole of the second plate, wherein the motion control mechanism comprises a handle that is connected to at least one wedge block, the at least one wedge block being movable between a first position within a socket defined within the intermediate support component and a second position that is engaged with the first plate; and a leg component comprising a first pair of legs and a second pair of legs, each of the first pair of legs and the second pair of legs being joined to the second plate.

* * * * *